US009205941B2

(12) United States Patent
Bush et al.

(10) Patent No.: US 9,205,941 B2
(45) Date of Patent: Dec. 8, 2015

(54) PAINT SAMPLE MIXING AND VENDING MACHINE

(75) Inventors: Daniel Bush, Novi, MI (US); John Jackson, Bloomfield Township, MI (US); Stephane Sauve, Windsor (CA); William Rotner, Acampo, CA (US)

(73) Assignee: CPS COLOR EQUIPMENT SPA CON UNICO SOCIO, San Felice Sul Panaro (IT)

( * ) Notice: Subject to any disclaimer, the term of this patent is extended or adjusted under 35 U.S.C. 154(b) by 819 days.

(21) Appl. No.: 13/509,772

(22) PCT Filed: Nov. 15, 2010

(86) PCT No.: PCT/US2010/002975

§ 371 (c)(1),
(2), (4) Date: May 14, 2012

(87) PCT Pub. No.: WO2011/059506

PCT Pub. Date: May 19, 2011

(65) Prior Publication Data

US 2013/0111849 A1 May 9, 2013

Related U.S. Application Data

(60) Provisional application No. 61/261,427, filed on Nov. 16, 2009, provisional application No. 61/323,243, filed on Apr. 12, 2010.

(51) Int. Cl.
*B65B 65/00* (2006.01)
*B01F 9/00* (2006.01)
(Continued)

(52) U.S. Cl.
CPC ..... *B65B 65/00* (2013.01); *B01F 9/0001* (2013.01); *B01F 13/1072* (2013.01); *G07F 13/06* (2013.01)

(58) Field of Classification Search
CPC ..... B01F 13/1055–13/1072; B01F 9/0001; B01F 2215/005; B65B 65/00; G07F 13/06
USPC ..... 53/167, 235, 237, 239, 249, 258, 266.1, 53/268, 281–283, 284.5, 287, 300, 285, 53/317–328, 331.5; 366/605; 141/104, 141/105
See application file for complete search history.

(56) References Cited

U.S. PATENT DOCUMENTS 2,606,707 A 8/1952 Tambini et al.
2,828,593 A * 4/1958 Colgren et al. ..... 53/76
(Continued)

FOREIGN PATENT DOCUMENTS

CA 1301936 C 5/1992
EP 1428569 A2 6/2004
(Continued)

OTHER PUBLICATIONS

Form PCT/IPEA/409 International Preliminary Report on Patentability.
(Continued)

*Primary Examiner* — Thanh Truong
*Assistant Examiner* — Joshua Kotis
(74) *Attorney, Agent, or Firm* — McNair Law Firm, P.A.; Seann P. Lahey

(57) ABSTRACT

A fully automated paint sample mixing and vending machine including an inventory section holding a plurality of containers with a base paint solution. The containers are individually dispensed onto a shuttle unit when a color is selected. The shuttle unit delivers the container to a capping unit for cap removal. After cap removal, the container moves on the shuttle unit to a colorant dispensing unit where various colorant paint solutions are injected into the base paint solution. Following tinting, the shuttle unit returns the container to the capping unit where the cap is securely reattached. The container is then delivered to a shaker unit where the container is rigorously shaken to mix the base and colorant solutions together to provide a uniform solution of consistent color. The container is then transported by the shaker unit to a delivery chute where the container is provided to the customer.

23 Claims, 29 Drawing Sheets

(51) Int. Cl.
*B01F 13/10* (2006.01)
*G07F 13/06* (2006.01)

(56) References Cited

U.S. PATENT DOCUMENTS

| | | | | |
|---|---|---|---|---|
| 4,312,172 | A | 1/1982 | Fisher et al. | |
| 4,526,215 | A * | 7/1985 | Harrison et al. | 141/83 |
| 4,588,302 | A * | 5/1986 | Pizzi et al. | 366/349 |
| 4,750,419 | A * | 6/1988 | Meredith | 101/40 |
| 4,917,264 | A * | 4/1990 | Gasiel et al. | 221/124 |
| 4,953,985 | A | 9/1990 | Miller | |
| 4,967,938 | A | 11/1990 | Hellenberg | |
| 5,083,591 | A * | 1/1992 | Edwards et al. | 141/9 |
| 5,163,484 | A | 11/1992 | Howlett et al. | |
| 5,328,057 | A | 7/1994 | Hellenberg et al. | |
| 5,368,196 | A | 11/1994 | Hellenberg et al. | |
| 5,493,840 | A * | 2/1996 | Cane | 53/50 |
| 6,146,009 | A * | 11/2000 | Boers | 366/247 |
| 6,328,180 | B1 * | 12/2001 | Sorensen et al. | 221/131 |
| D472,253 | S | 3/2003 | Reedy et al. | |
| 6,615,881 | B2 * | 9/2003 | Bartholomew et al. | 141/18 |
| 6,827,478 | B2 * | 12/2004 | Becker et al. | 366/108 |
| 6,834,478 | B2 | 12/2004 | Peronek et al. | |
| 7,099,740 | B2 | 8/2006 | Bartholomew et al. | |
| 7,134,573 | B2 | 11/2006 | Post | |
| 7,228,879 | B2 * | 6/2007 | Miller et al. | 141/271 |
| 7,311,223 | B2 | 12/2007 | Post | |
| 7,406,808 | B1 | 8/2008 | Martin | |
| 7,493,190 | B1 | 2/2009 | Tomassi | |
| 7,562,680 | B2 * | 7/2009 | Khoo et al. | 141/86 |
| 8,162,174 | B2 * | 4/2012 | Hieb et al. | 221/210 |
| 2002/0091596 | A1 | 7/2002 | Dudek et al. | |
| 2004/0076075 | A1 * | 4/2004 | Avanzi et al. | 366/209 |
| 2006/0087914 | A1 * | 4/2006 | Eckart, Jr. | 366/209 |
| 2006/0109740 | A1 * | 5/2006 | Huckby | 366/208 |
| 2007/0247967 | A1 * | 10/2007 | Johnson et al. | 366/217 |
| 2008/0051936 | A1 * | 2/2008 | Lindblom | 700/239 |
| 2008/0251546 | A1 | 10/2008 | Khoo et al. | |
| 2009/0248199 | A1 * | 10/2009 | Milhorn | 700/239 |

FOREIGN PATENT DOCUMENTS

| | | | |
|---|---|---|---|
| EP | 1600678 | A2 | 11/2005 |
| KR | 2001058037 | A | 7/2001 |

OTHER PUBLICATIONS

PCT International Search Report and Written Opinion for PCT/US2010/002975 with attachments.

European Search Report and Search Opinion for PCT/US2010/002975.

* cited by examiner

Fig. 25
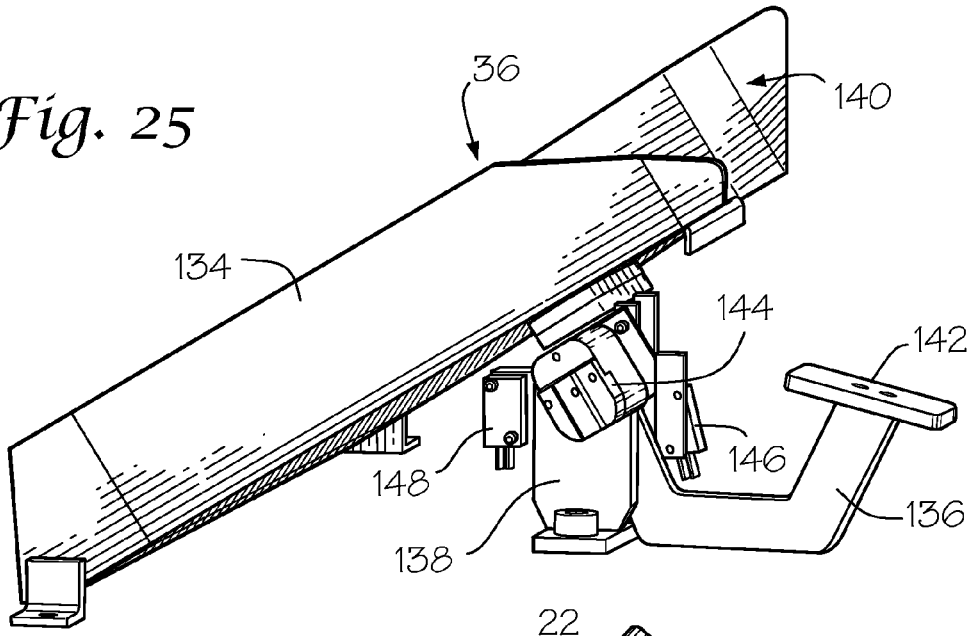
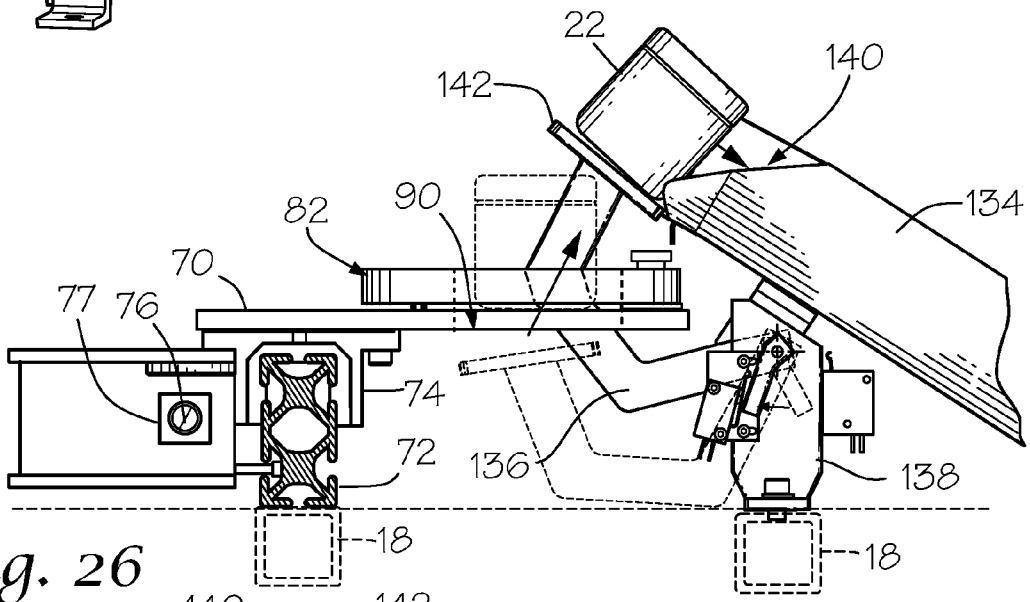
Fig. 26
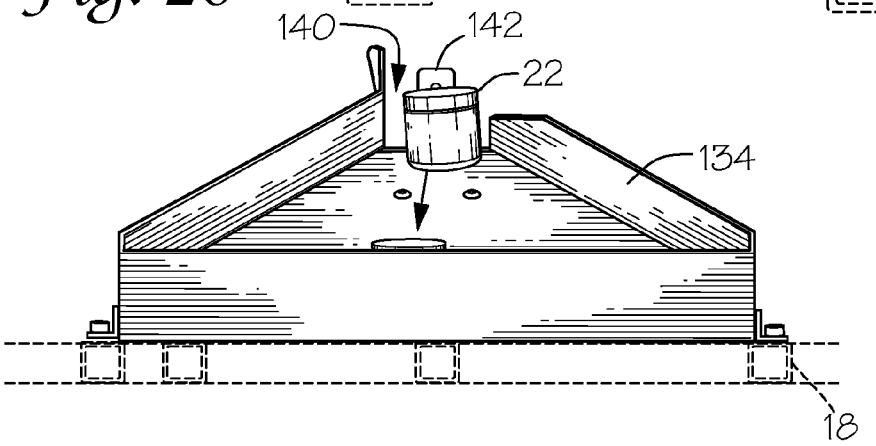
Fig. 27

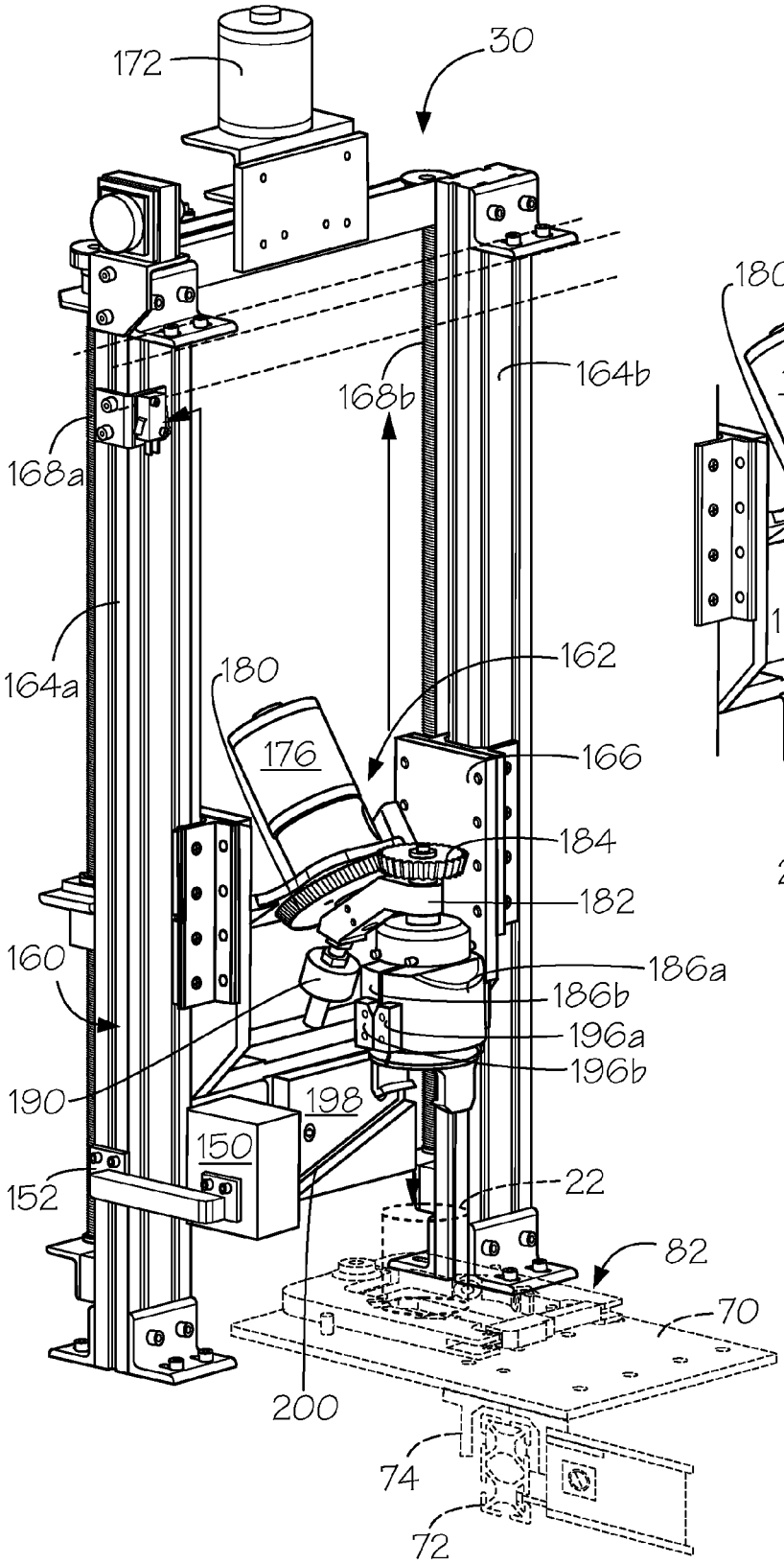
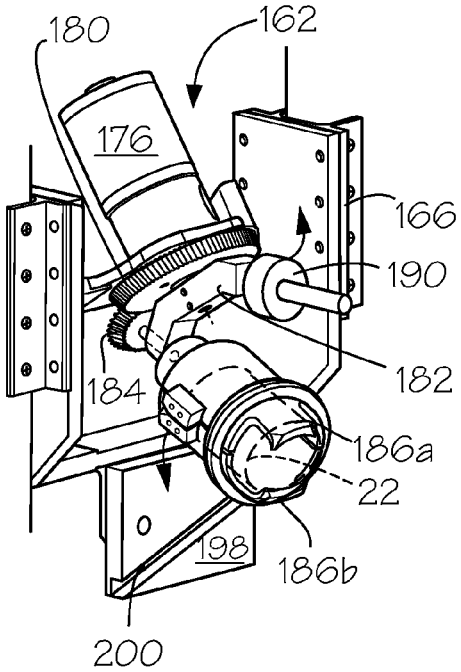
Fig. 28
Fig. 29

PAINT SAMPLE MIXING AND VENDING MACHINE

CROSS REFERENCE TO RELATED APPLICATIONS

This application claims priority from U.S. Provisional Application No. 61/261,427, filed 16 Nov. 2009 and U.S. Provisional Application No. 61/323,243, filed 12 Apr. 2010.

BACKGROUND OF THE INVENTION

1) Field of the Invention

The present invention relates to vending machines, and more particularly, to a compact self-contained paint sample vending machine capable of coloring, mixing and dispensing sample containers of paint solution.

2) Description of Related Art

Typically, when a consumer is deciding on various paint colors for a room, the usual sample provided by the paint supply is a quart size container. To prepare the sample, the customer will typically presents a selected color splotch to an attendant who then physically retrieves a can of base paint solution, inserts the can into a colorant dispenser, and then places the can into a mixer for several minutes. The process usually takes five to ten minutes, if not longer, to complete. This is far more paint than is needed for the intended evaluation purpose of choosing a room color. This creates an unnecessary environmental disposal issue as tons of wasted paint is delivered to landfills. This also presents an unnecessary cost obstacle to those looking for paint. Some stores provide smaller paint samples, but these come in premixed colors. Thus, while they are less expensive, the consumer has a highly limited color pallet to select from.

It is known in the art that there are large scale versions of fully automated paint retrieval and mixing systems. These are typically warehouse type sized systems that operate with gallon size and larger quantities of paint. For point of sale suppliers looking to provide smaller custom paint samples, these large systems are entirely impractical as they require massive storage and operational area that is simply not available in common retail space. Even in typical paint stores and big box home improvement stores, there must be a large work and storage area to hold quart and gallon size paint cans, as well as the colorant dispenser and mixer device, for a worker to prepare a custom paint sample.

Accordingly, there is a need in the industry for an automated compact custom paint sample mixing and vending machine which can provide smaller than quart sized cans of paint, mix the base paint solution with a colorant selected by a customer from a large pallet of colors, and deliver the sample rapidly, without the need for a large work area and storage space for cans of base paint solution as is typically required in the industry.

Thus, it is an object of the present invention to provide an automated paint sample mixing and vending machine with reduced foot print to allow for point of sale retail location operation.

It is another object of the present invention to provide an automated paint sample mixing and vending machine that is entirely self-contained in its operation to store, mix and dispense a plurality of sample paint containers.

It is another object of the present invention to provide an automated paint sample mixing and vending machine which dispenses custom selected paint samples in, for example, smaller 8 to 16 fluid ounce paint containers to avoid excess waste.

It is another object of the present invention to provide an automated paint sample mixing and vending machine capable of rapidly adding and mixing a colorant paint solution to a base paint solution in a sample paint container to provide a complete custom selected paint sample to a customer in only a few minutes.

SUMMARY OF THE INVENTION

The above objectives are accomplished according to the present invention by providing a compact self-contained automated paint sample mixing and vending machine as detailed herein below. Within a support frame, the apparatus includes an inventory section for holding a plurality of paint containers with a removable cap, preferably a twist-off cap. Each paint container holds a base paint solution for mixing with various colorant paint solutions to vend a selected custom paint color chosen by a customer through a user interface. The inventory section may also contain a variety of different base paint solutions. The paint containers are individually dispensed from the inventory section into a shuttle unit when a color is selected. The shuttle unit first delivers a paint container to a capping unit for removal and attachment of the removable as required. Once the cap is removed, the paint container is advanced on the shuttle unit to a colorant dispensing unit where the various colorant paint solutions are injected into the base paint solution to provide the selected color. Following the operations at the colorant dispensing unit, the shuttle unit returns the paint container to the capping unit where the cap is reattached. The paint container is then delivered to a shaker unit where the paint container is removed from the shuttle and rigorously shaken to mix the base paint solution and the colorant paint solution into a single uniform solution of consistent color. The paint container is then transported by the shaker unit to a delivery chute where it is ejected for delivery to the customer. In the event of a system error in mixing a container, a discard chute is also provide along the track of the shuttle unit.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIG. 25 shows a side perspective view of a discard chute according to the present invention;

FIG. 26 shows a side view of the discard show disposed along the track of the shuttle unit and ejecting a container from the shuttle unit according to the present invention;

FIG. 27 shows a front view of the discard chute according to the present invention;

FIG. 28 shows a detailed front perspective view of the shaker mechanism in the shaker unit according to the present invention;

FIG. 29 shows a front perspective view of the shaker unit disposed along the track of the shuttle unit according to the present invention;

The objects noted above and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a specific embodiment, it will be appreciated that the description is illustrative of the invention and is not constructed as limiting of the invention. Various modifications and applications may occur to those who are skilled in the art, without departing from the spirit and the scope of the invention, as described and claimed herein. Likewise, other objects, features, benefits and advantages of the present invention will be apparent from the summary and certain embodiments described below, and will be readily apparent to those skilled in the art.

DETAILED DESCRIPTION OF A PREFERRED EMBODIMENT

Figure 1:
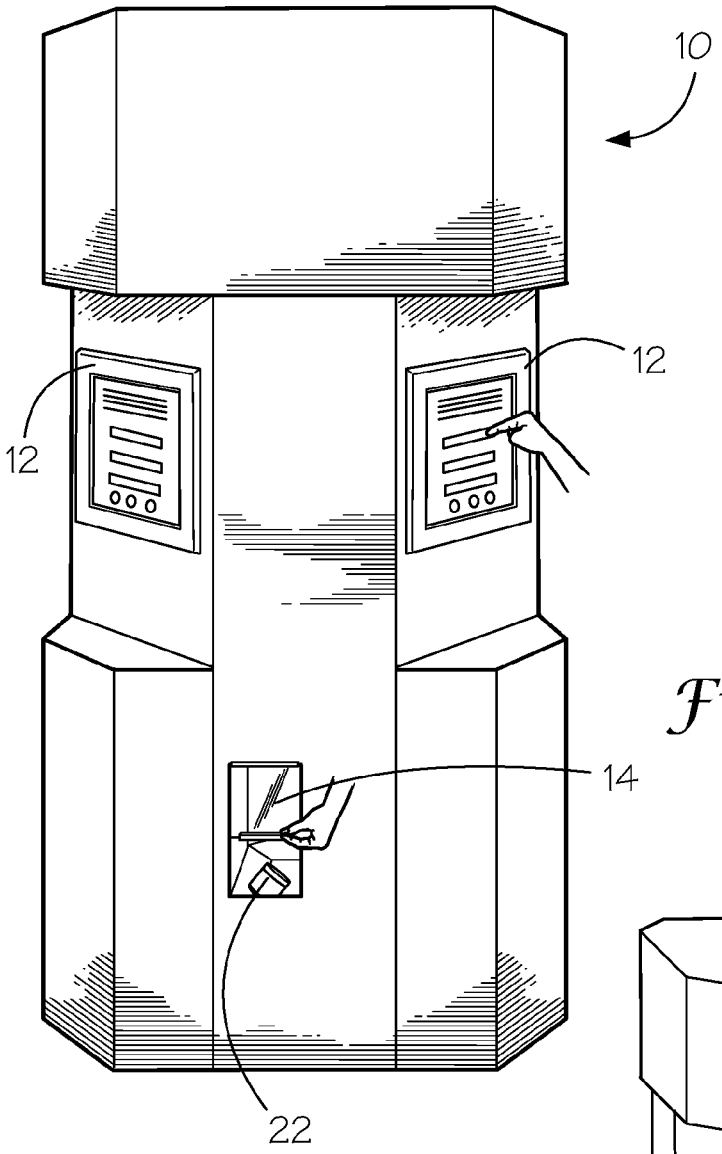
FIG. 1 shows a front view of the exterior of the paint sample mixing and vending machine according to the present invention.
Figure 2:
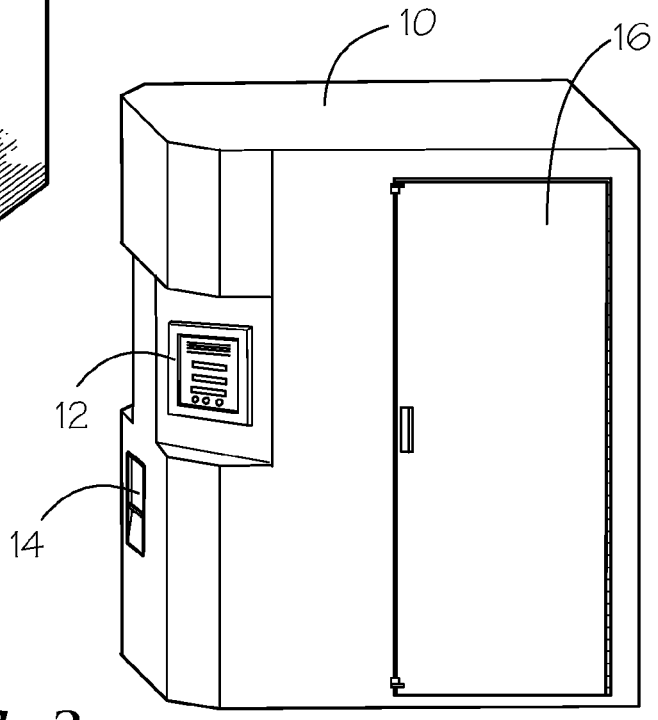
FIG. 2 shows a side view of the exterior of the paint sample mixing and vending machine according to the present invention.

With reference to the drawings, the invention will now be described in more detail. Referring to FIGS. 1 and 2, an example of a compact self-contained automated paint sample mixing and vending machine is illustrated. In one embodiment, vending machine 10 includes a user interface 12 for selecting a custom paint color to be provided. User interface 12 may be, for example, any number of touch screen or keypad devices. A delivery chute dispenses a paint container after mixing through opening 14. As specifically shown in FIG. 2, vending machine 10 preferably includes an access door 16 for attending to the internal components, such as for restocking and repair.

Figure 3:
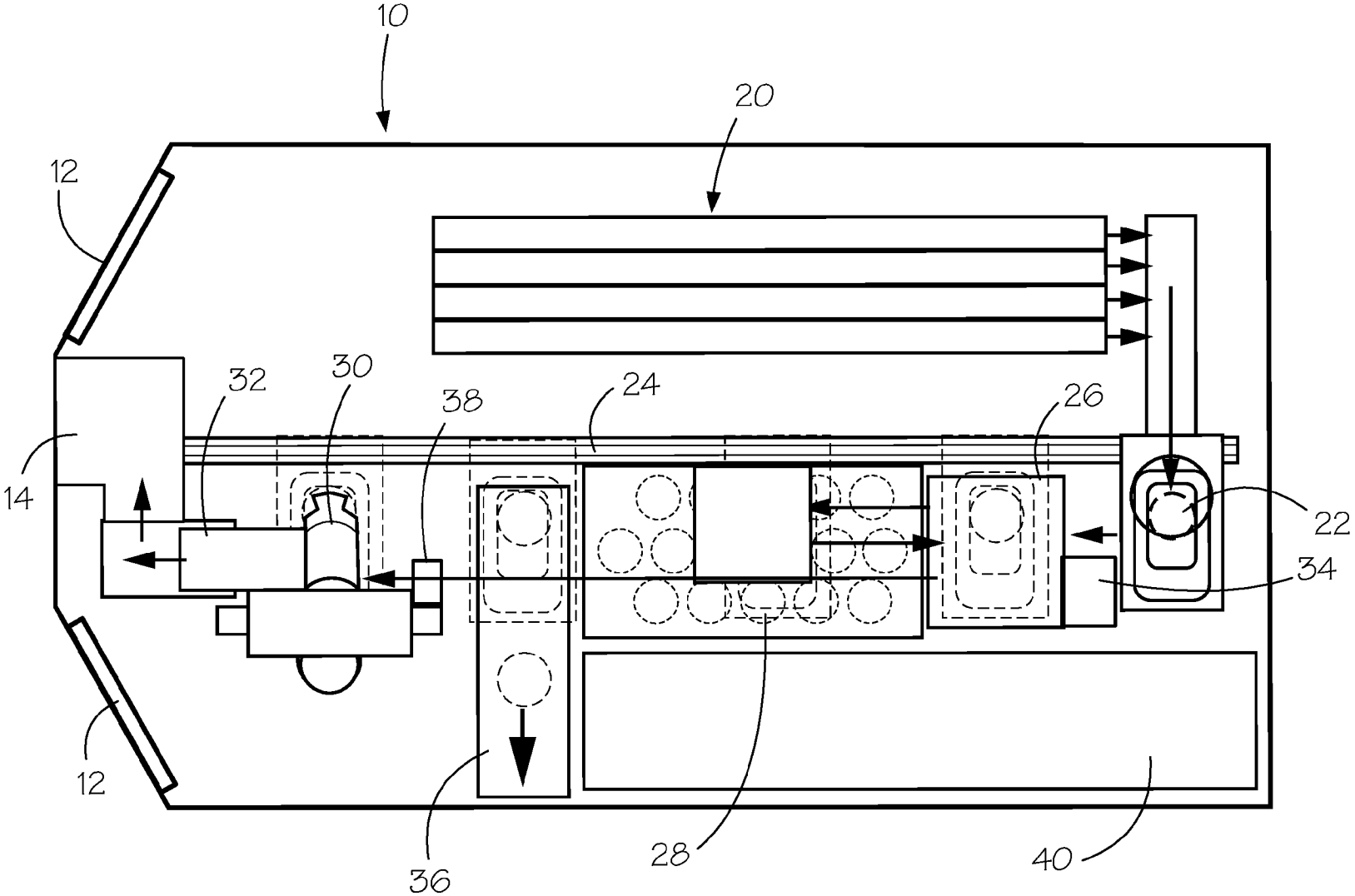
FIG. 3 shows a schematic arrangement of the paint sample mixing and vending machine components according to the present invention.
Figure 4:
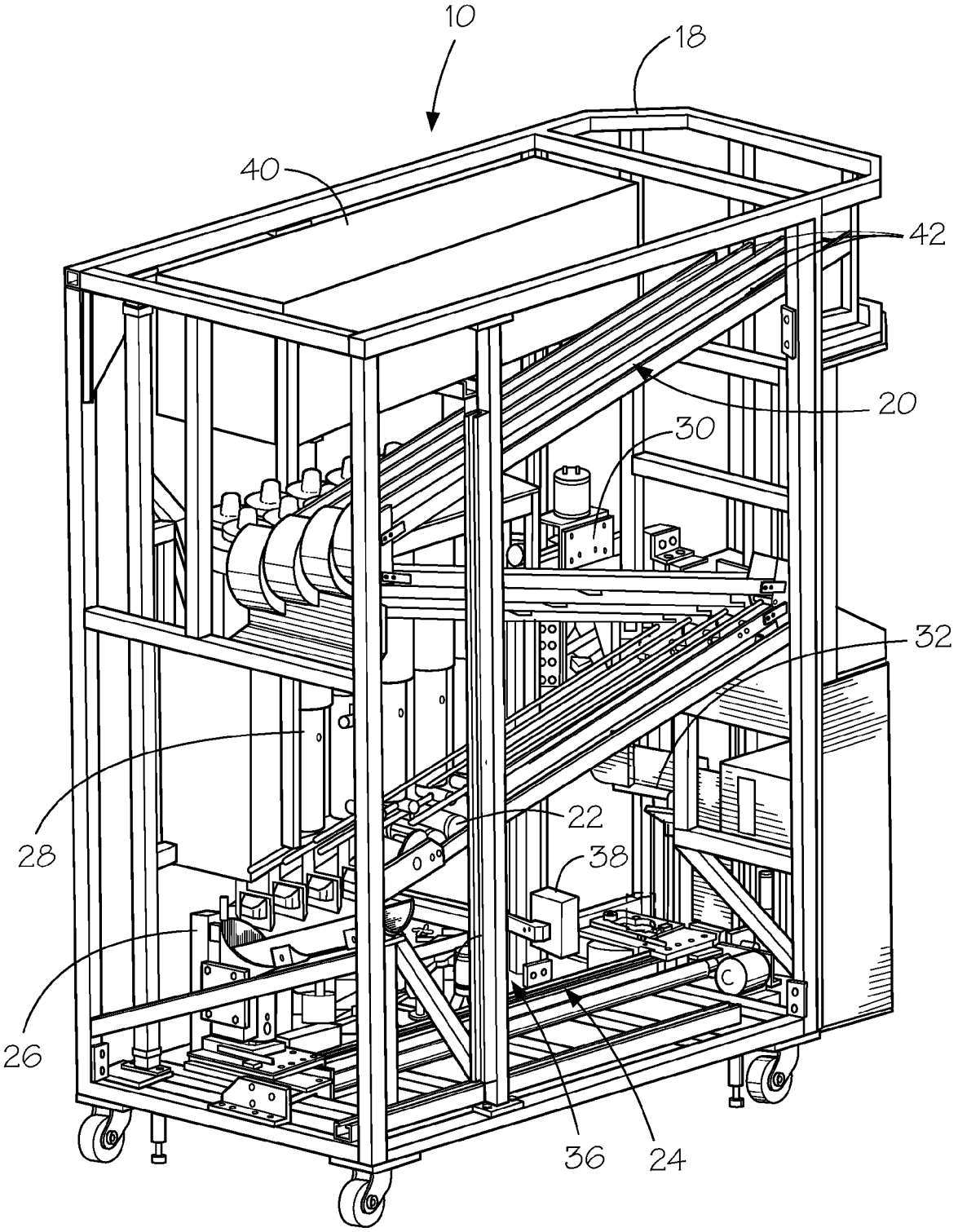
FIG. 4 shows a side perspective view of the paint sample mixing and vending machine internal components in an assembled configuration according to the present invention.

Referring to FIGS. 3 and 4, within a general support frame 18, the apparatus includes an inventory section, designated generally as 20, for holding a plurality of containers with a removable cap. Each container holds a base paint solution for mixing with various colorant paint solutions to vend a selected paint color chosen by a customer through user interface 12. In one embodiment, each paint container 22 would hold approximately 8 fluid ounces of custom mixed paint when delivered to the customer. While the invention is not limited to this size of container, it is preferred in order to limit unnecessary waste while providing sufficient paint for testing and a large inventory in a relatively small machine. It is further contemplated that inventory section 20 may hold containers with various base paint solutions to offer a broad range of not only color choices but finishes as well. The containers 22 are individually dispensed from inventory section 20 onto a shuttle unit, designated generally as 24, when a color is selected. The shuttle unit 24 first delivers a container 22 to a capping unit, designated generally as 26, designed to unscrew a twist-off cap and to then reattach the cap. Once the cap is removed, container 22 is advanced along a shuttle track of the shuttle unit to a colorant dispensing unit, designated generally as 28. At this stage, various colorant paint solutions (tints) are injected into the base paint solution of container 22 to create the selected color. Following tinting at colorant dispensing unit 28, shuttle unit 24 returns container 22 to capping unit 26 where the cap is reattached. Container 22 is then delivered to a shaker unit, designated generally as 30, where container 22 is removed from shuttle unit 24 and rigorously shaken to mix the base and colorant solutions together. Container 22 is then transported by shaker unit 30 to a dispenser chute 32 where it is ejected for delivery to the customer at opening 14. The system also includes a scanner 34, which may be carried by the capping unit to read bar code information printed on the containers to ensure that a proper container was provided for the selected color. A discard chute 36 is provided to ejected containers when a fault is detected. In one embodiment, a printer 38 is disposed along the track of shuttle unit 24 to print various identification or other useful information onto container 22 before being delivered to the customer. Also located within support frame 18 are the electronic computer control components, designated generally as 40, to operate the various systems noted above. The above description sets forth one basic functional arrangement of the major components for illustrative purposes, but it is contemplated that the arrangement and cooperation can be altered to adapt the system to suit different size requirements for a given retail space without departing from the spirit and scope of the present invention.

Figures 5, 6:
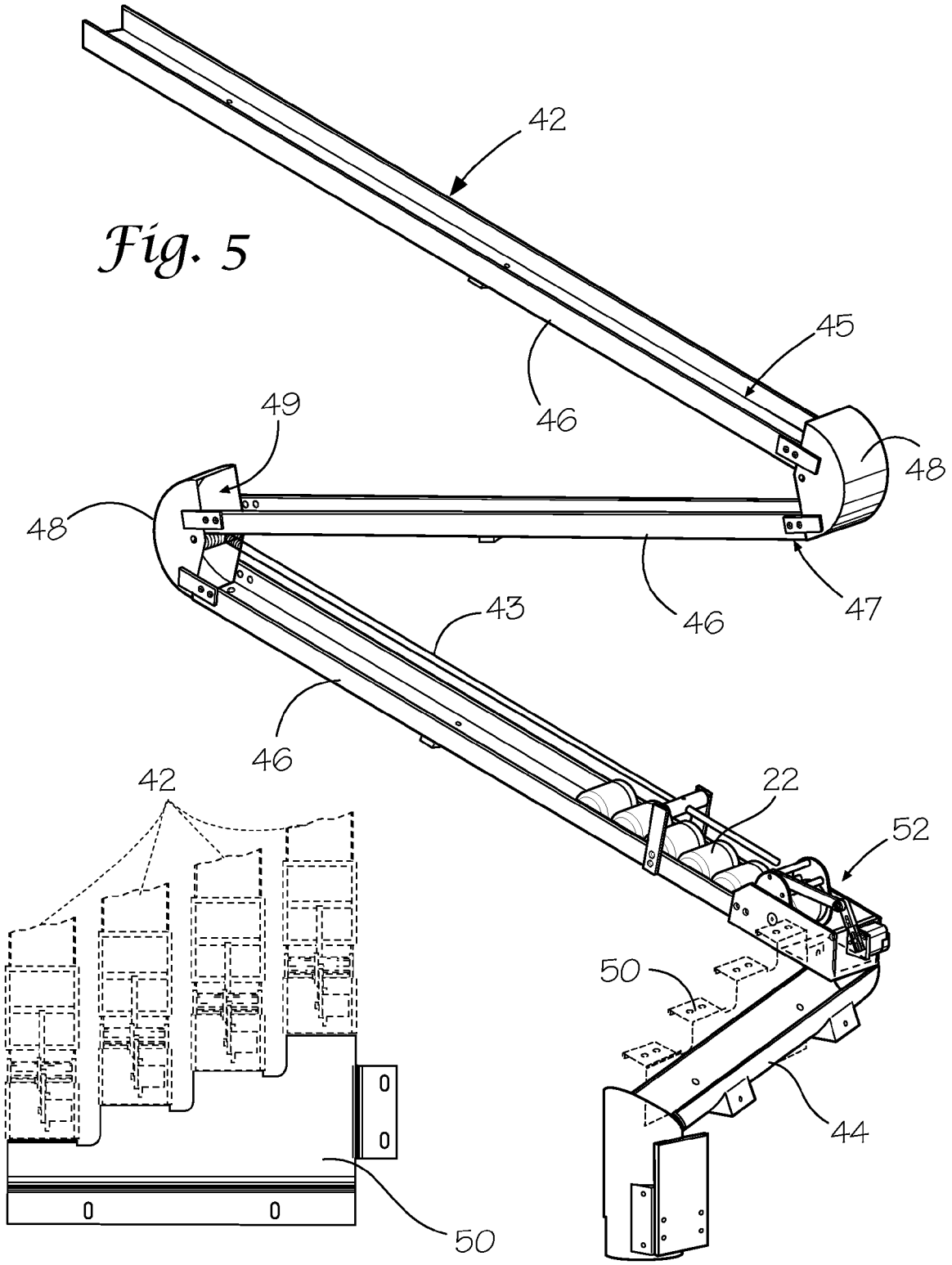
FIG. 5 shows a rail unit of the inventory section according to the present invention.
FIG. 6 shows a mounting rack for a plurality of rail units according to the present invention.
Figure 7:
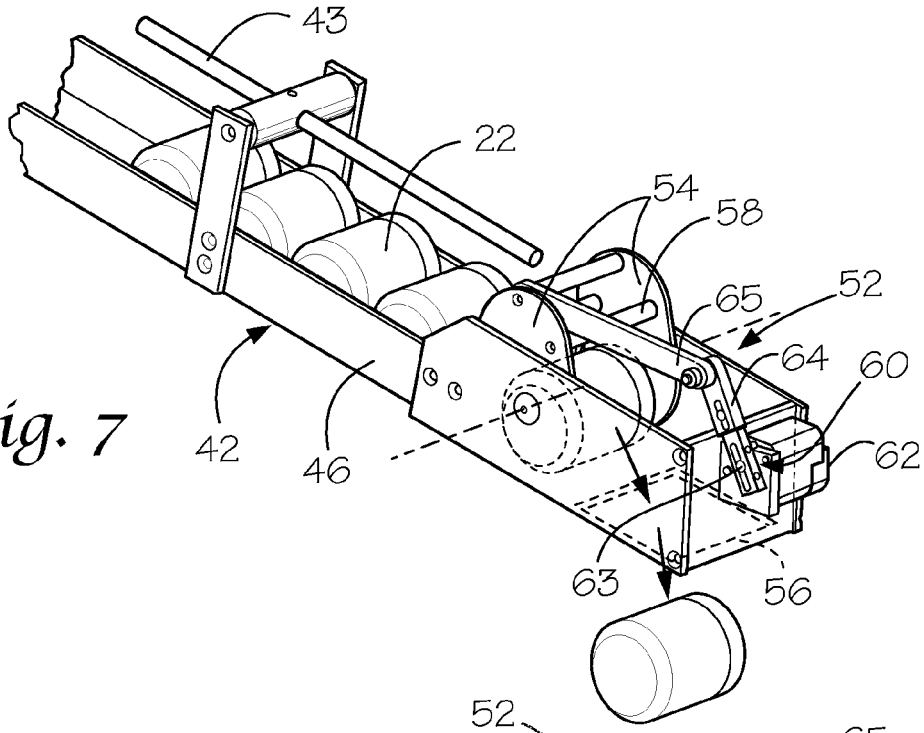
FIG. 7 shows a detailed perspective view of a control gate of a rail unit according to the present invention.
Figure 8A:
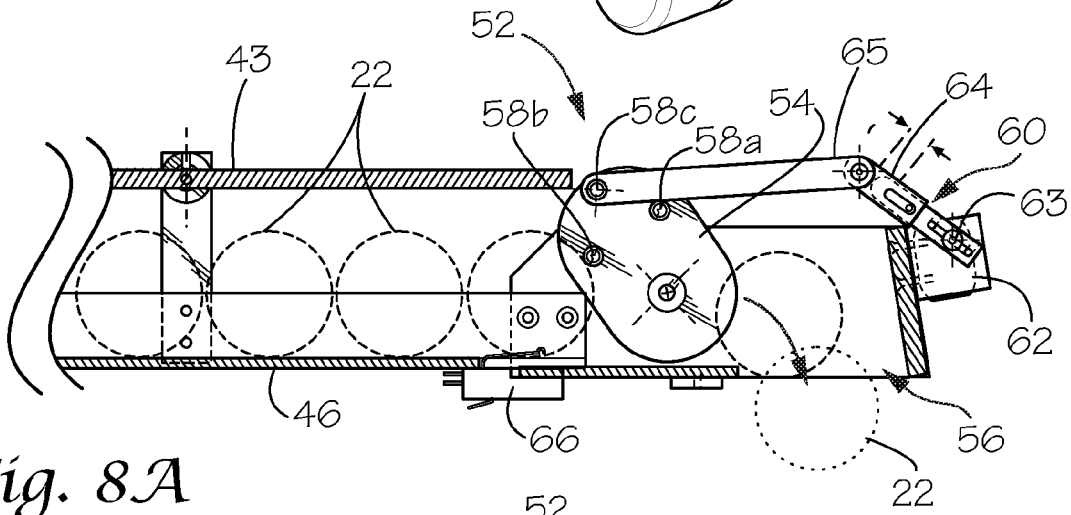
FIGS. 8A and 8B show side view of the control gate operation dispensing a container according to the present invention.
Figure 8B:
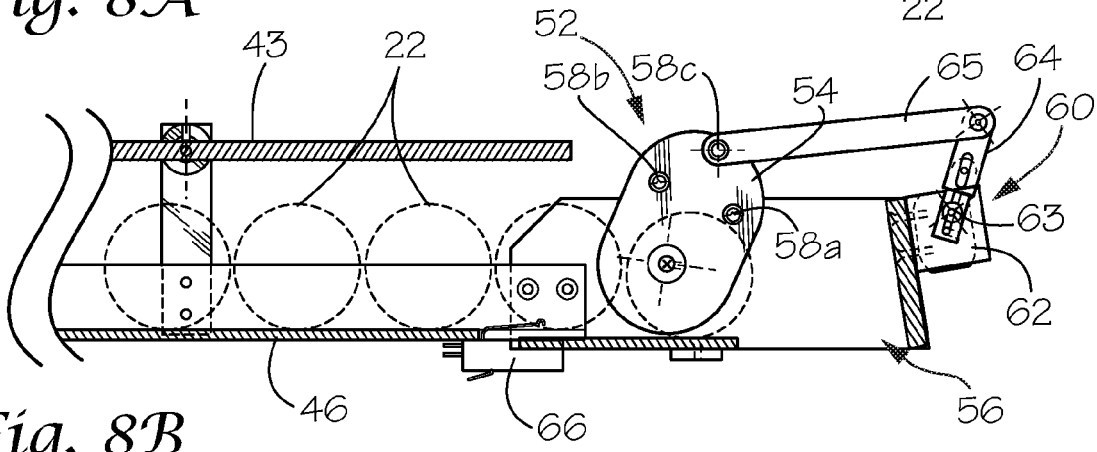
Figure 9:
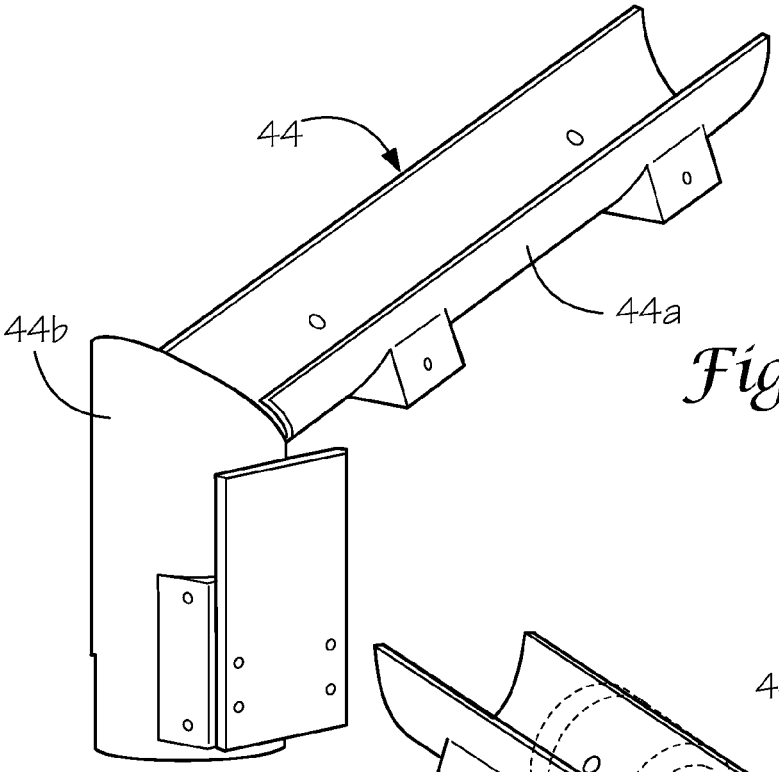
FIG. 9 shows a perspective view of a feed chute according to the present invention.
Figure 10:
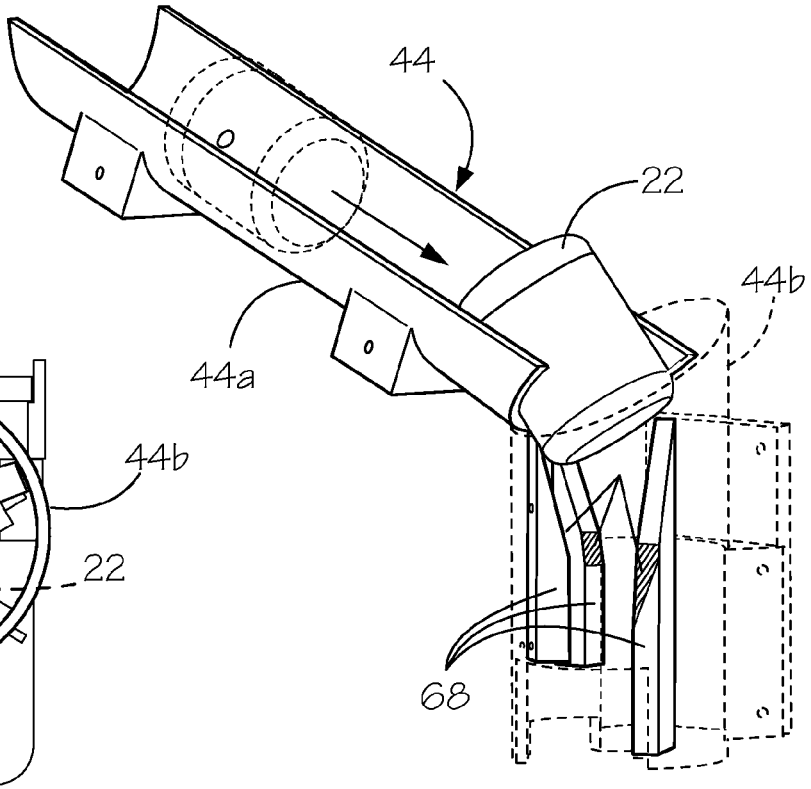
FIG. 10 shows a perspective cut-away view of the feed chute according to the present invention.
Figure 11:
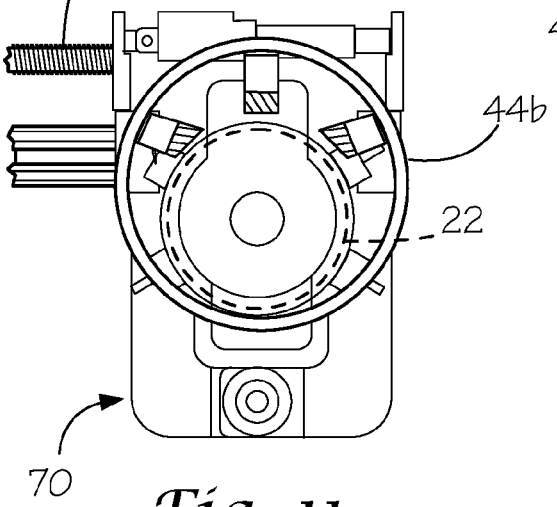
FIG. 11 shows a top plane view of the feed chute delivering a container to a shuttle unit according to the present invention.
Figure 12:
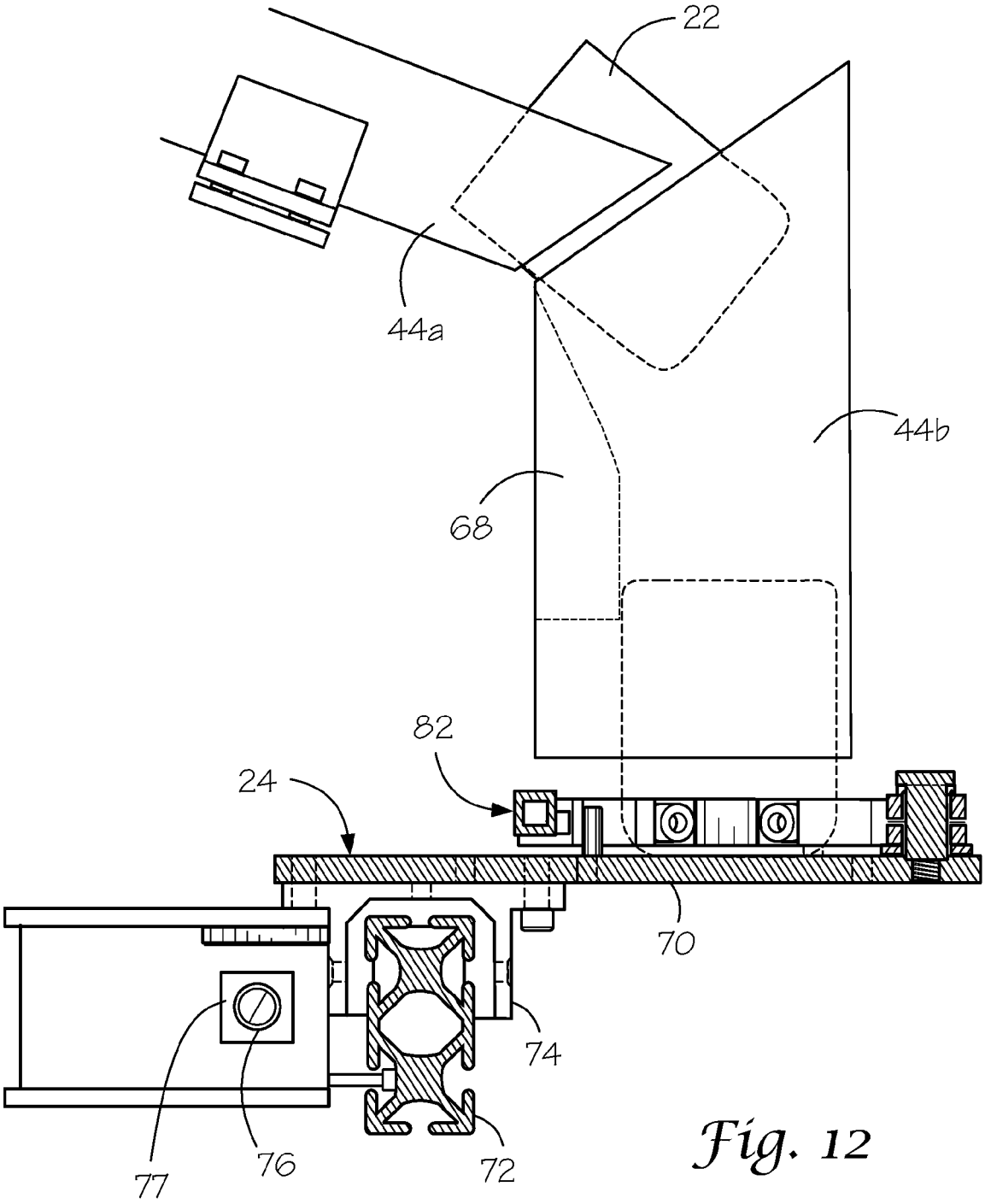
FIG. 12 shows a side cross-section view of the feed chute delivering a container to the shuttle unit according to the present invention.

With further reference to FIGS. 5-12, inventory section 20 includes a plurality of rail units, designated generally as 42, aligned within support frame 18 defining an arrangement of inclined troughs. A plurality of containers 22 each holding a base paint solution and having a removable cap are carried in the troughs so that the containers can roll through the troughs using only gravity. Rail units 42 deliver containers 22 into a feed chute 44 for delivering the containers to shuttle unit 24. Rail units 42 are each constructed and arranged to include a series of trough sections 46 interconnected at their distal ends by a series of end caps 48. Trough sections 46 are angled to gravity feed containers 22 along each trough section. Trough sections 46 are further arranged in a spaced vertical layout within support frame 18 with the distal ends of adjacent trough sections, for example, distal ends 45 and 47, interconnected by end caps 48, which transfer containers 22 between the vertically spaced trough sections 46. End caps 48 each include a curved interior chute 49 that receives containers 22 from a distal end 45 of a first trough section 46 and dispenses containers 22 to an adjacent distal end 47 of a second lower trough section 46 so that a single continuous inclined trough is formed to deliver a supply of containers 22 to feed chute 44. A support rod 43 may be carried by each trough section 46 and attached to an end cap 48 to improve stability of each rail unit 42. Referring to FIG. 6, the series of rail units 42 are carried on a mounting rack 50 at one distal end adjacent feed chute 44. Mounting rack 50 is constructed and arranged to vertically step the distal ends of the rail units 42 to maintain a consistent spacing in relating to the inclined arrangement of feed chute 44.

At the end of each rail unit 42 is a control gate, designated generally as 52, operatively associated with feed chute 44 for selectively dispensing containers 22 into feed chute 44 for progressing onto shuttle unit 24. Control gate 52 includes a pair of rotatable cams 54 disposed on opposite sides along the interior of each trough section 46 adjacent a dispensing slot 56. Dispensing slot 56 is positioned directly over feed chute 44 so that a container 22 which is dispensed from a rail unit 42 falls through dispensing slot 56 and into the feed chute 44. A series of crossbars 58 link cams 54 for blocking the path of containers through trough sections 46 into dispensing slot 56. An actuator 60 is operatively associated with cams 54 to rotate the cams between a forward position, in which containers 22 are prevented from being feed into dispending slot 56, and a rearward position, in which the container located at the distal most location in trough section 46 adjacent dispensing slot 56 is free to feed into dispensing slot 56 and drop onto feed chute 44. More particularly, referring to FIGS. 8A and 8B, when cams 54 are in a forward position (FIG. 8B) containers 22 are blocked from entering dispensing slot 56 by crossbar 58*a*. When cams 54 are in a rearward position (FIG. 8A), crossbar 58*a* prevents the next consecutive container in trough section 46 from feeding into dispensing slot 56 while allowing the first container in the trough section to enter dispensing slot 56. Accordingly, as cams 54 cycle from the forward to the rearward position and back, a single container is allowed enter dispensing slot 56 and drop onto feed chute 44. Actuator 60 is rotatably connected to crossbar 58*c* so that cams 54 can be rotated between the forward and rearward positions.

In the illustrated embodiment, actuator 60 includes electric motor 62, for example, a servo motor, that is operatively connected to a series of pivotally interconnected arms. Electric motor 62 includes a drive shaft 63 affixed to a first arm 64. As the motor is operated, first arm 64 can be cycled forward and back. First arm 64 is pivotally connected to a second elongated arm 65. Second arm 65 is pivotally connected to crossbar 58*c* to move cams 54 between the forward and rearward positions. Accordingly, as electric motor 62 moves first arm 64, second arm 65 is cycled forwards or backwards to move cross bar 58*c* and thus rotate cams 54. A sensor 66 can be provided to monitor the passing of containers 22 into dispensing slot 56

Referring to FIGS. 9-12, feed chute 44 is an inclined trough 44*a* that transitions into a generally vertical sleeve 44*b*. Vertical sleeve 44*b* preferably includes a plurality of guide rails 68 disposed around at least a portion of the interior circumference cooperating with containers 22 to position containers 22 onto a container carrier 70 of shuttle unit 24.

Referring to FIGS. 12-15, as a container 22 exits feet chute 44, it is received by shuttle unit 24 for transportation to the various processes in the machine including capping unit 26, colorant dispensing unit 28, discard chute 36, and shaker unit 30. Shuttle unit 24 includes a container carrier 70 movably mounted to a shuttle track 72 carried by support frame 18. Container carrier 70 receives containers 22 from feed chute 44 and transports the containers along shuttle track 72.

In the illustrated embodiment, shuttle track 72 extend generally horizontally along a lower portion of support frame 18. The track generally runs from feed chute 44 to shaker unit 30 (see FIGS. 3 and 4). Container carrier 70 is mounted to shuttle track 72 by a bracket 74 slidable along the track. Bracket 74 includes several guide elements 75 engaging grooves in shuttle track 72 to form a tongue and groove arrangement to help direct bracket 74 along shuttle track 72. Container carrier 70 consists of a generally horizontal plate extended from bracket 74. The plate of container carrier 70 extends underneath vertical sleeve 44*b* of feed chute 44 for receiving containers 22 in an upright orientation. It also positions the container to be engaged by capping unit 26, colorant dispensing unit 28, discard chute 36, and shaker unit 30.

Figures 13, 14:
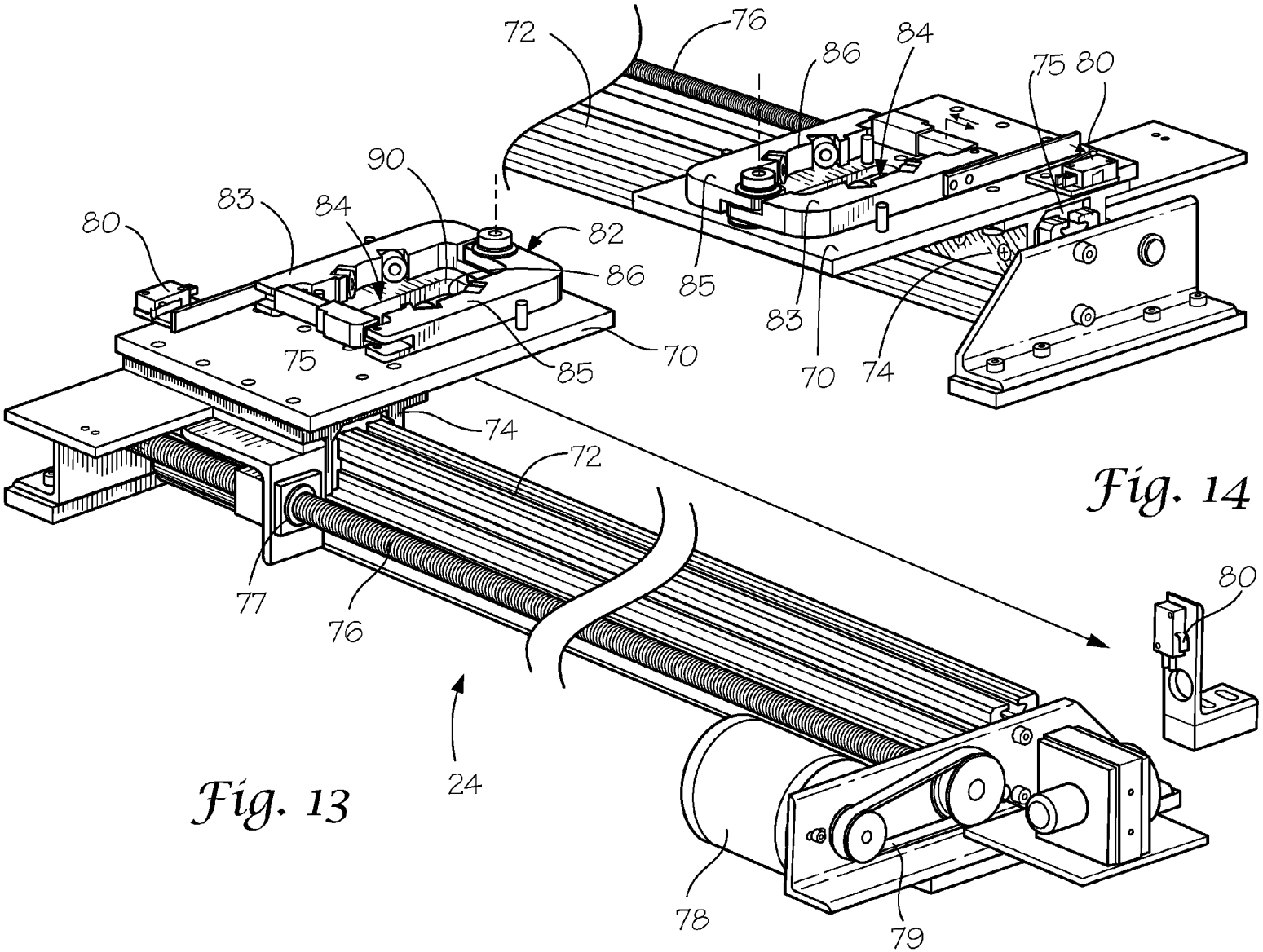
FIG. 13 shows a rear perspective view of the shuttle unit according to the present invention.
FIG. 14 shows a front perspective view of the shuttle unit according to the present invention.

To move bracket 74 and container carrier 70 along shuttle track 72, a screw shaft 76 extends generally parallel to shuttle track 72 and is operatively connected to bracket 74 by a threaded collar 77. As screw shaft 76 is rotated, threaded collar 77 travels along shaft 76 and causes bracket 74 to be moved along shuttle track 72. As best shown in FIG. 13, to affect rotation of screw shaft 76, a motor 78 is mounted to a distal end of shuttle track 72 and operatively connected to screw shaft 76 through a belt drive 79 arrangement or similar means to cause rotation of screw shaft 76. In a preferred embodiment, motor 78, as well as all major drive motors in the machine responsible for movement or rotation of containers 22 and the removable cap are servo motors. Using servo motors, the system can be precisely monitored to track the exact location, orientation, and rotation of various elements of the machine, the benefits of which will be immediately apparent to those skilled in the art.

In combination with the servo motors, various position sensors 80 may nevertheless be utilized to confirm the position of the shuttle along track 72, or as otherwise desired to monitor various elements of the machine, such as rotation of the capping unit assembly, movement of the shaker unit, position of delivery chute, etc. In the illustrated embodiment, position sensors 80 are simple contact switches located at the home position of container carrier 70 under feed chute 44 and again at the end of the track where container carrier 70 is positioned under shaker unit 30.

Alternatively, to monitor the position of container carrier 70, a cable measurement monitoring device (not shown) may be connected bracket 74. As the cable is withdrawn from a housing mounted to support frame 18, the length of the cable is precisely monitored and reported to the system control elements. By measuring the distance of the cable in relation to shuttle track 72, the exact position of the container carrier 70 can be constantly monitored.

Container carrier 70 includes a carrier clamp, designated generally as 82, receiving containers 22 from feed chute 44 and securing containers 22 to container carrier 70 for transport along shuttle track 72. Carrier clamp 82 includes a first clamping arm 83 having a recess 84 complementary to an exterior shape of container 22. A second clamping arm 85 is mounted opposite from first clamping arm 83. Second clamping arm 85 also includes a recess 86 complementary to the shape of container 22 for cooperating with first clamping arm 83 to hold container 22 on container carrier 70.

Figure 15:
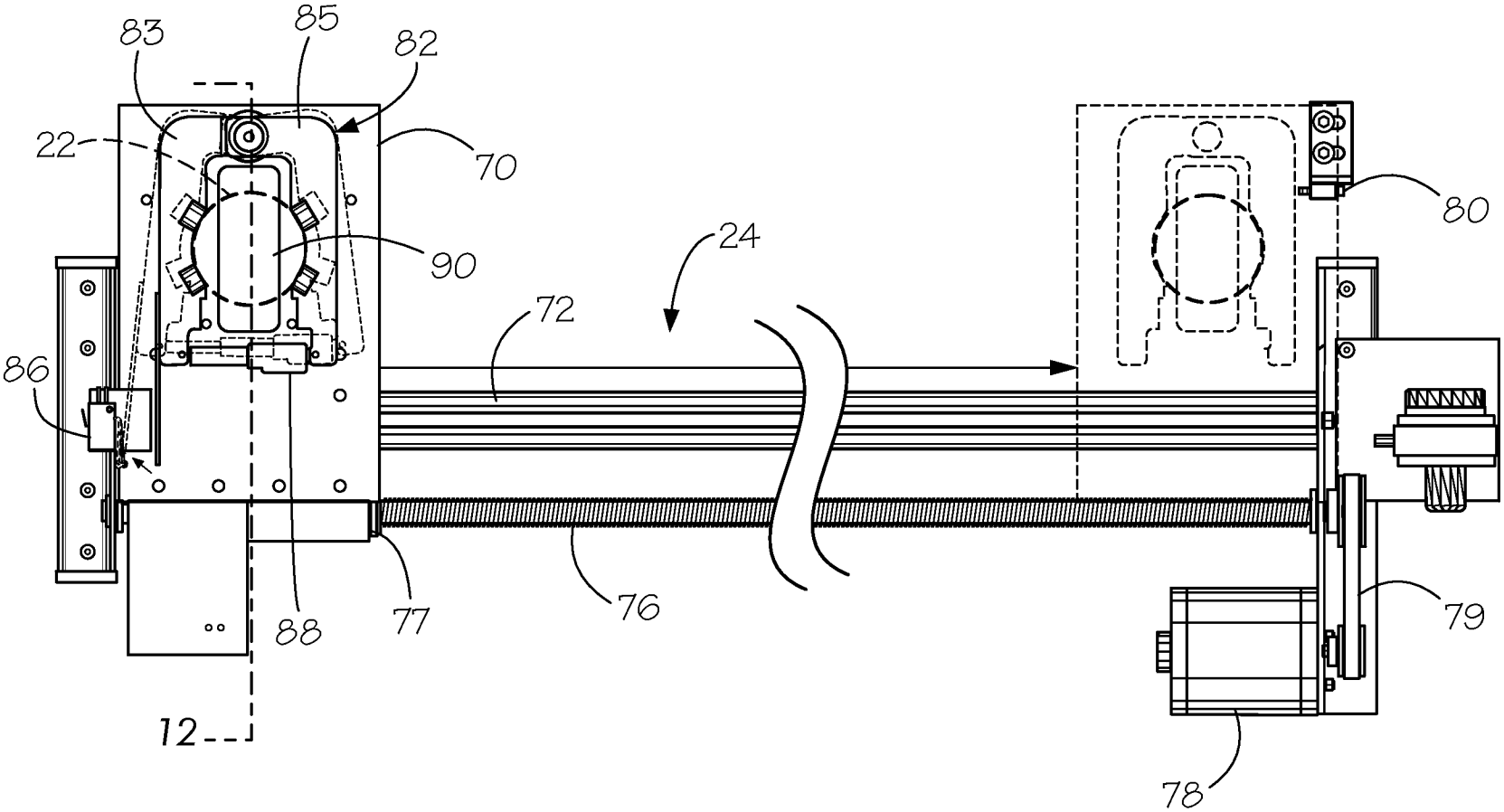
FIG. 15 shows a top plan view of the shuttle unit according to the present invention.
Figure 16:
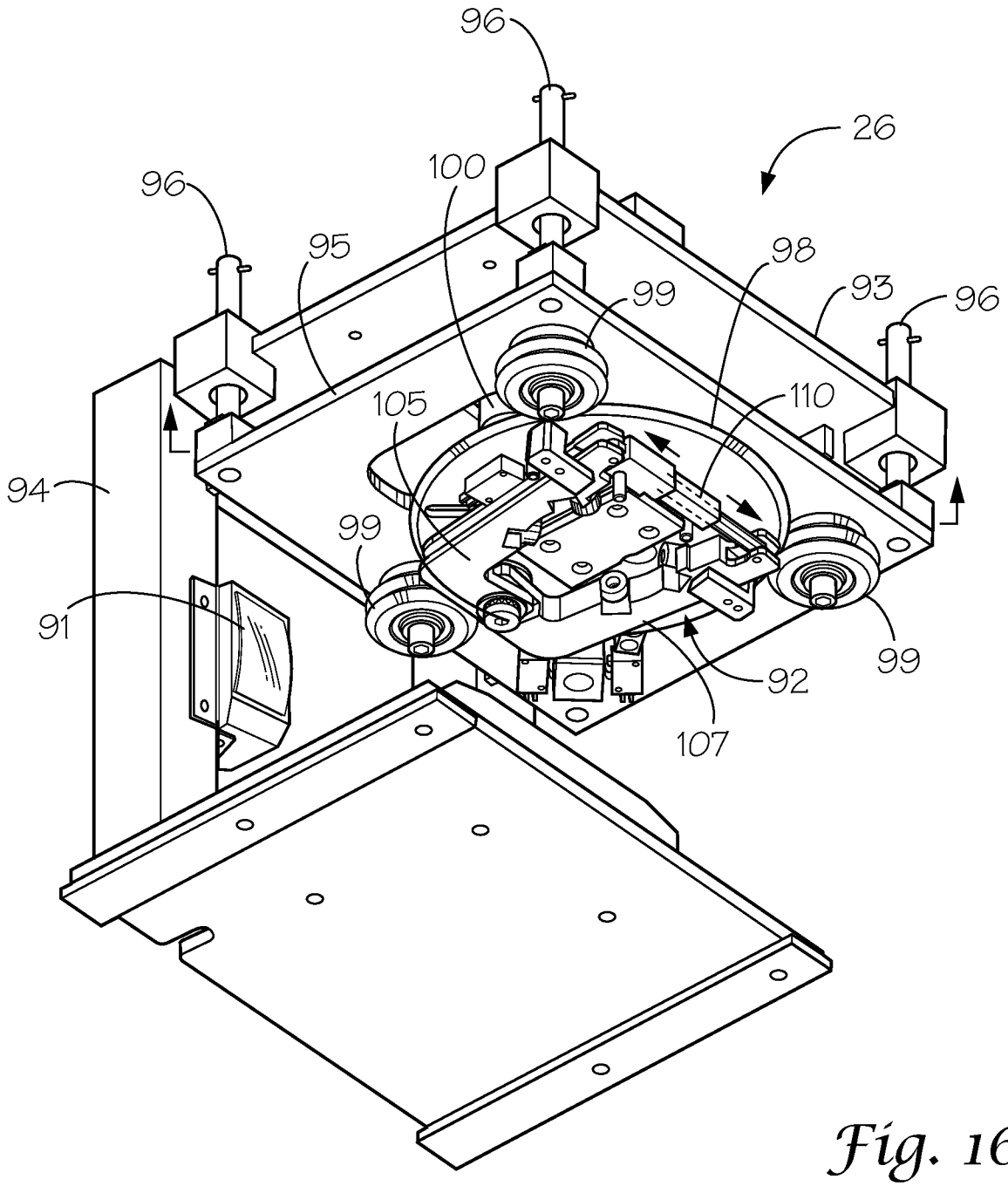
FIG. 16 shows a bottom perspective view of the capping unit according to the present invention.

Referring to FIG. 15, in operation, at least one of the clamping arms 83 and 85 is movable between an open position, where a container 22 may be received into carrier clamp 82, and a closed position, where a container 22 is clamped and held in the recess 84 and 86 of clamping arms 83 and 85. To affect movement of the clamping arm(s), a linear actuator 88 is provided that is operatively connected to at least one of the clamping arms for moving between the open and closed positions. Also, an opening 90 is disposed in container carrier 70 to allow an ejector arm to push containers upward from underneath container carrier 70 and into a discard chute, as discussed further herein below.

Referring to FIGS. 16-21C, capping unit 26 will now be described in detail. In operation, once container carrier 70 receives and clamps container 22 in position, shuttle unit 24 moves container carrier 70 to capper unit 26. Capper unit 26 then lowers onto the top of container 22 and by way of a cap clamp, designated generally as 92, clamps onto the twist-off removable cap 22*a*. In a preferred embodiment, before removing cap 22*a* however, carrier clamp 82 on container carrier 70 releases, allowing cap clamp 92 to rotate the entire container 22. This initial rotation allows a scanner unit 91 (FIG. 16), disposed adjacent cap clamp 92, to read a bar code label on container 22 to confirm that the proper base paint solution was dispensed from inventory section 20 and that the container is not upside down prior to removing paint container cap 22*a*. If the correct paint container was provided, carrier clamp 82 clamp onto container 22 and capping unit 26 will continue its process of removing cap 22*a*, but if the wrong container was provided, capping unit 26 will release container cap 22*a* and shuttle unit 24 will deliver container 22 to discard chute 36.

Capping unit 26 includes a stationary top plate 93 carried by a support structure 94 mounted to support frame 18. The support structure 94 is arranged to locate top plate 93 generally overtop of the path of container carrier 70 moving along shuttle track 72 of shuttle unit 24. A vertically movable grab plate 95 is carried by top plate 93. A series of guide posts 96 are carried generally at the distal corners of grab plate 95 and extend through top plate 93 to stabilize and control vertical movement of grab plate 95 relative to top plate 93 when moving to grab removable cap 22*a* on paint container 22. To affect vertical movement, a linear actuator 97 is carried by top plate 93 and operatively connected to grab plate 95 to move grab plate 95 between a lowered position (FIG. 21B) for engaging the twist-off cap 22*a* of container 22 and a raised position (FIGS. 21A and 21C) for removing paint container cap 22*a*.

Grab plate 95 carries a rotatable clamp mount plate 98. A series of guide wheels 99 are carried by grab plate 95 and engage a peripheral edge of clamp mount plate 98 to stabilize and control rotation of clamp mount plate 98 on a bottom side of grab plate 95. Rotation of clamp mount plate 98 is accomplished by a motor 100 carried by grab plate 95 and a series of teethed gears, designated generally as 101, operatively connecting motor 100 to clamp mount plate 98. In the illustrated embodiment, a first gear 102 is connected to a drive shaft of motor 103. A second gear 104 is mounted to clamp mount plate 98 and cooperatively engages first gear 102 so that rotation by first gear 102 causes second gear 104 to spin clamp mount plate 98.

The rotatable cap clamp 92 is carried on a bottom side of clamp mount plate 98 for engaging cap 22*a* of container 22. Cap clamp 92 is generally the same arrangement as carrier clamp 82 carried by container carrier 70 of shuttle unit 24. Accordingly, cap clamp 92 includes a first clamping arm 105 having a recess 106 complementary to the shape of the exterior on container cap 22*a*. A second clamping arm 107 is mounted opposite from first clamping arm 105. The second clamping arm 107 also includes a recess 108 complementary to the shape of the exterior on container cap 22*a* for cooperating with first clamping arm 105 to secure removable cap 22*a* to clamp mount plate 98.

In operation, at least one of clamping arms 105 and 107 is movable between an open position, where removable cap 22*a* may be received into cap clamp 92 on clamp mount plate 98, and a closed position, where cap 22*a* is clamped and held in the recesses 105 and 107 of clamping arms 105 and 107. To affect movement of the clamping arm(s), a linear actuator 110 is provided that is operatively connected to at least one of the clamping arms for moving between the open and closed positions. As illustrated, linear actuator 110 is carried at the distal ends of arms 105 and 107 to simultaneously push the arms apart (FIG. 17A) or draw them together (FIG. 17B) to clamp on cap 22*a*. The same arrange may be provided on carrier clamp 82.

In operation, once container 22 is scanned by scanner 91 and determined to be correct and not upside down, carrier clamp 82 moves to the closed position to firmly hold a bottom portion of container 22 in a stationary arrangement on container carrier 70. Cap clamp 92, which is already closed on removable cap 22*a*, is then rotated by turning clamp mount plate 98 while rising accordingly, which removes cap 22*a* from container 22. As cap 22*a* is removed, grab plate 95 is raised so that container carrier 70 can shuttle container 22 to colorant dispensing unit 28 to receive colorant and then return container 22 to capping unit 26 to have cap 22*a* reattached.

Figure 17A:
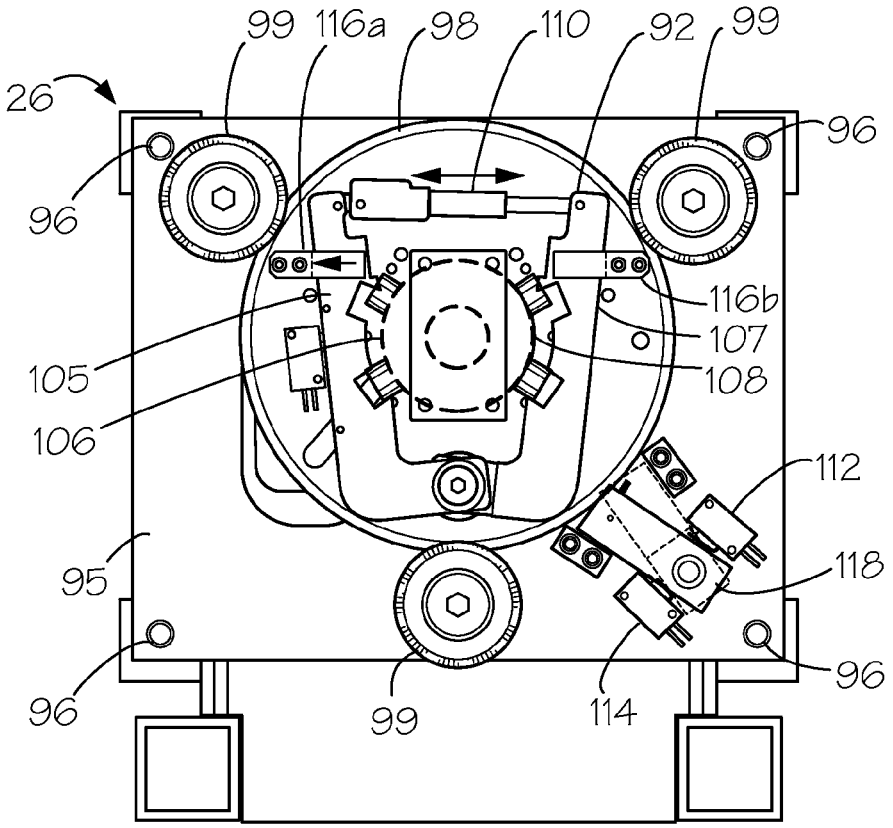
FIGS. 17A and 17B shows a bottom view of the rotatable cap clamp of the capping unit with the clamping arms in an open position and then in a closed position according to the present invention.
Figure 17B:
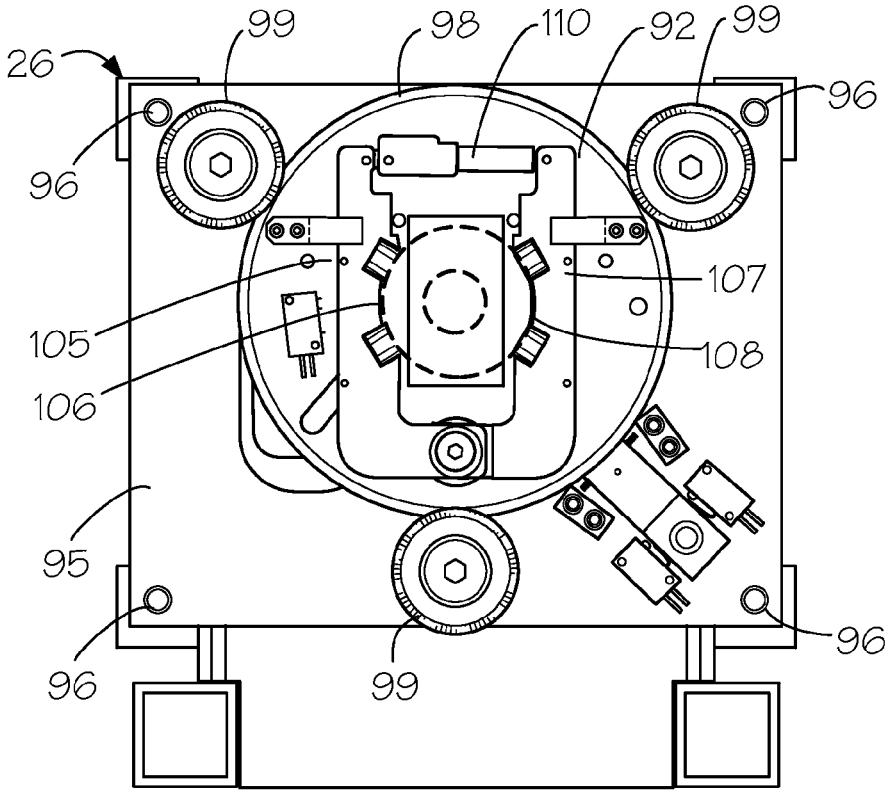
Figure 18:
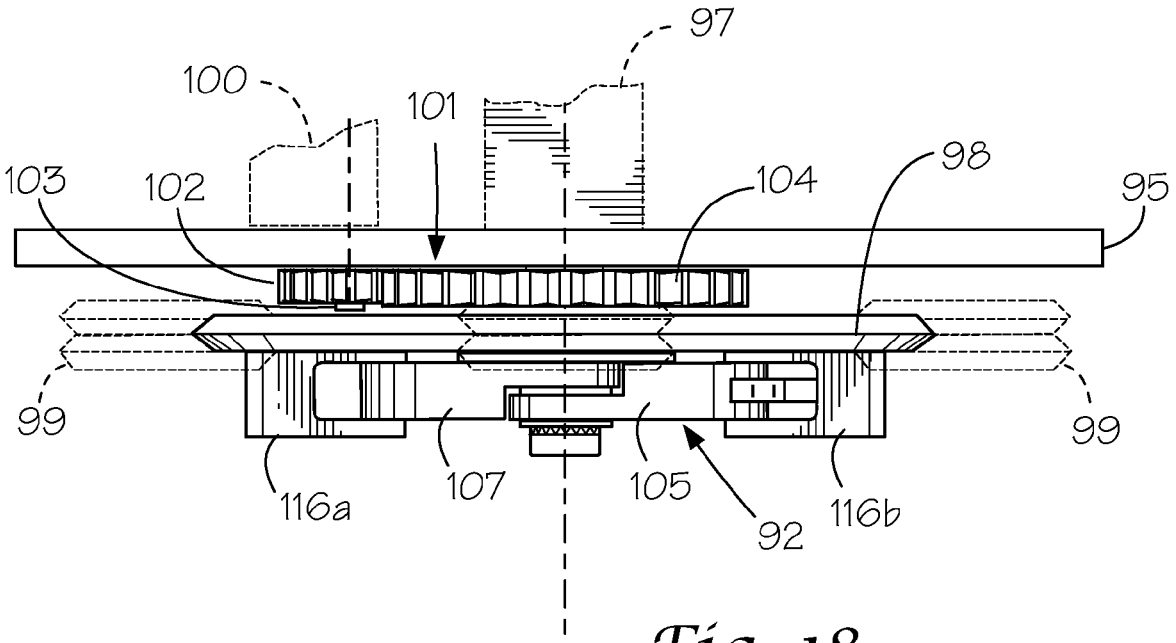
FIG. 18 shows a side view of the rotatable cap clamp according to the present invention.
Figure 19:
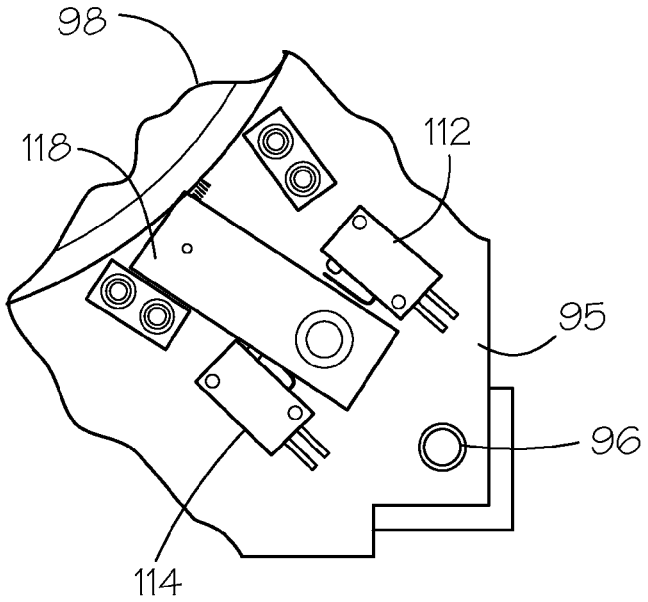
FIG. 19 shows a detailed close up view of a position sensor operatively associated with the rotatable cap clamp according to the present invention.
Figure 20:
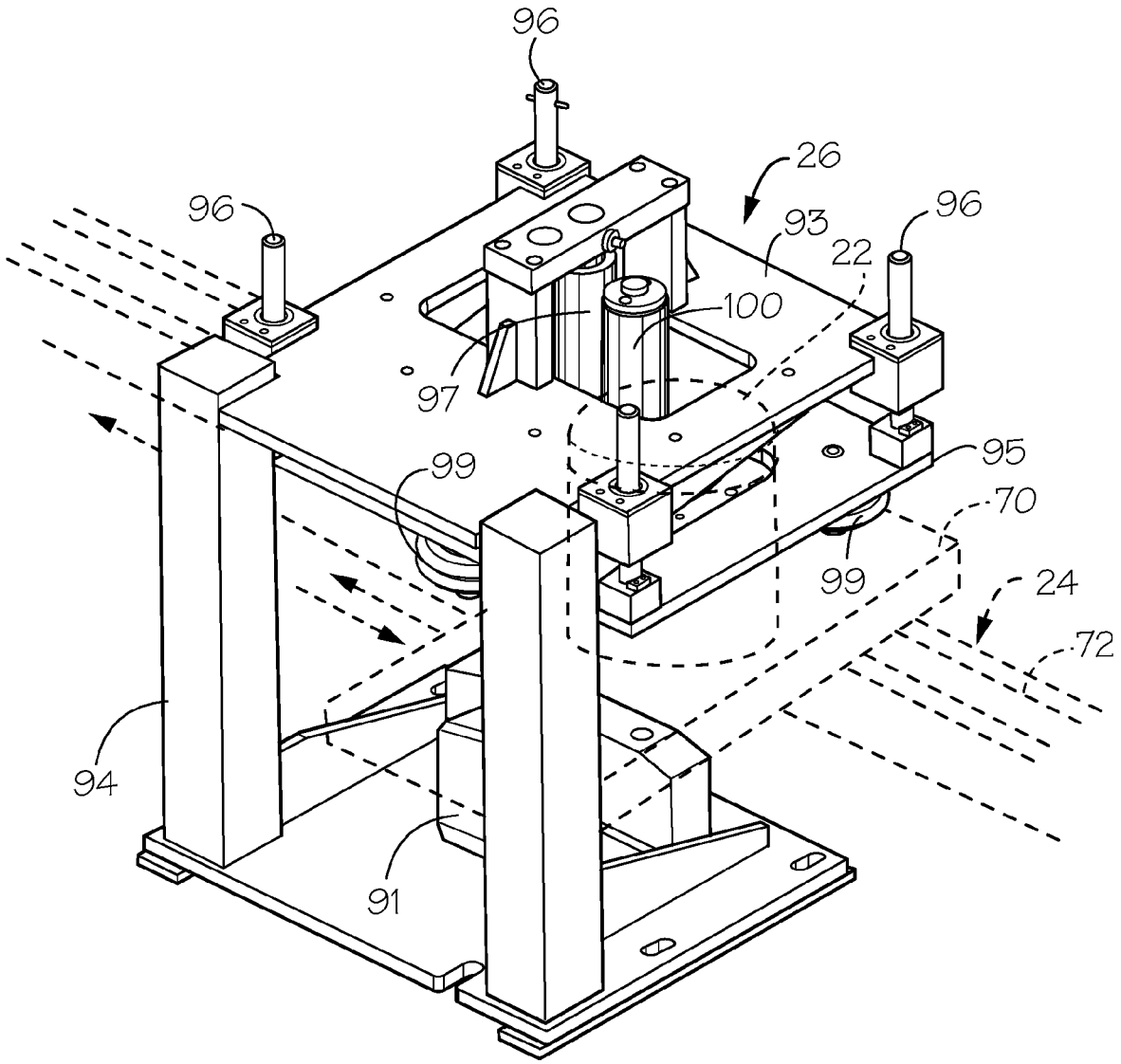
FIG. 20 shows a top perspective view of the capping unit disposed along the track of the shuttle unit according to the present invention.
Figure 21A:
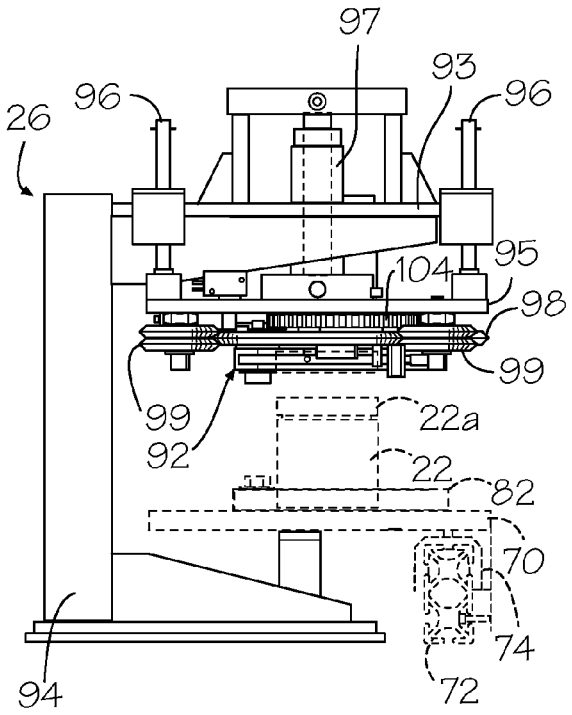
FIGS. 21A-21C show a side view of the capping unit moving between a raised position and a lowered position for engaging the containers.
Figure 21B:
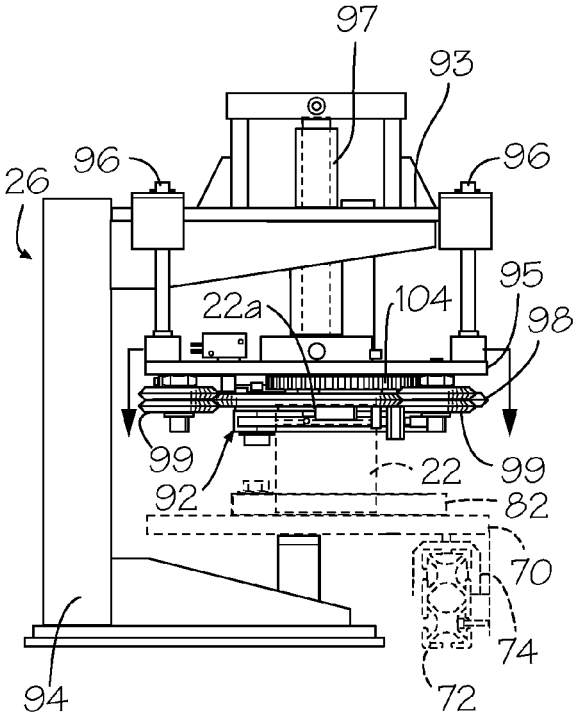
Figure 21C:
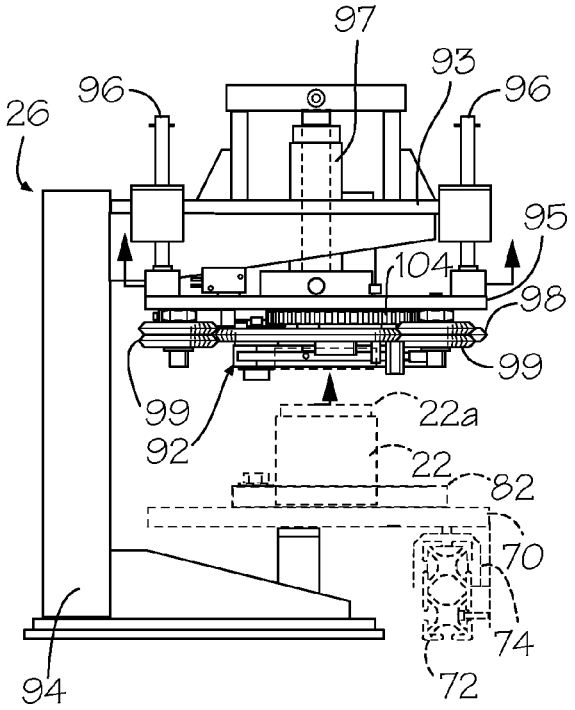
Figure 22:
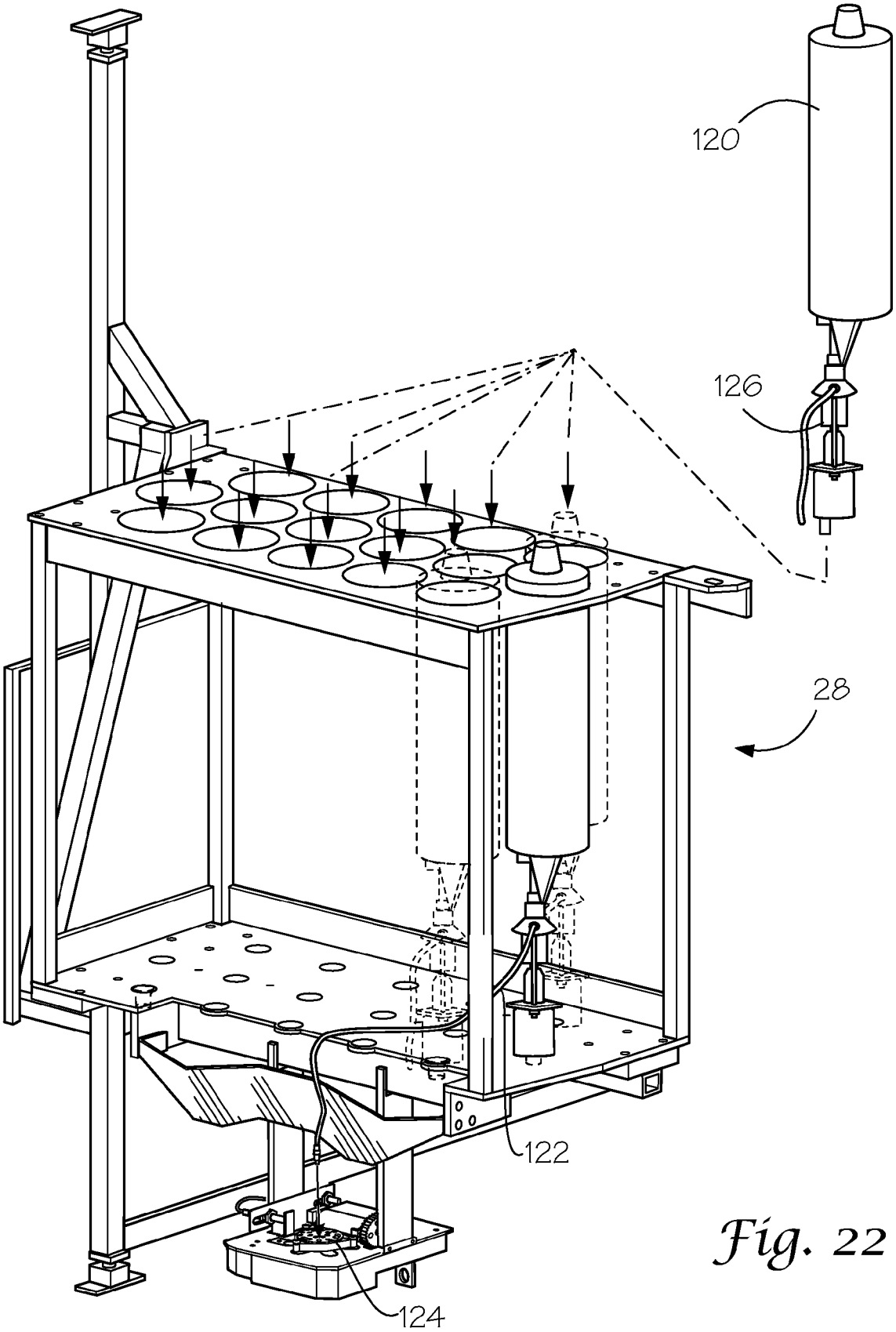
FIG. 22 shows an exploded perspective view of the colorant dispensing unit according to the present invention.
Figure 23:
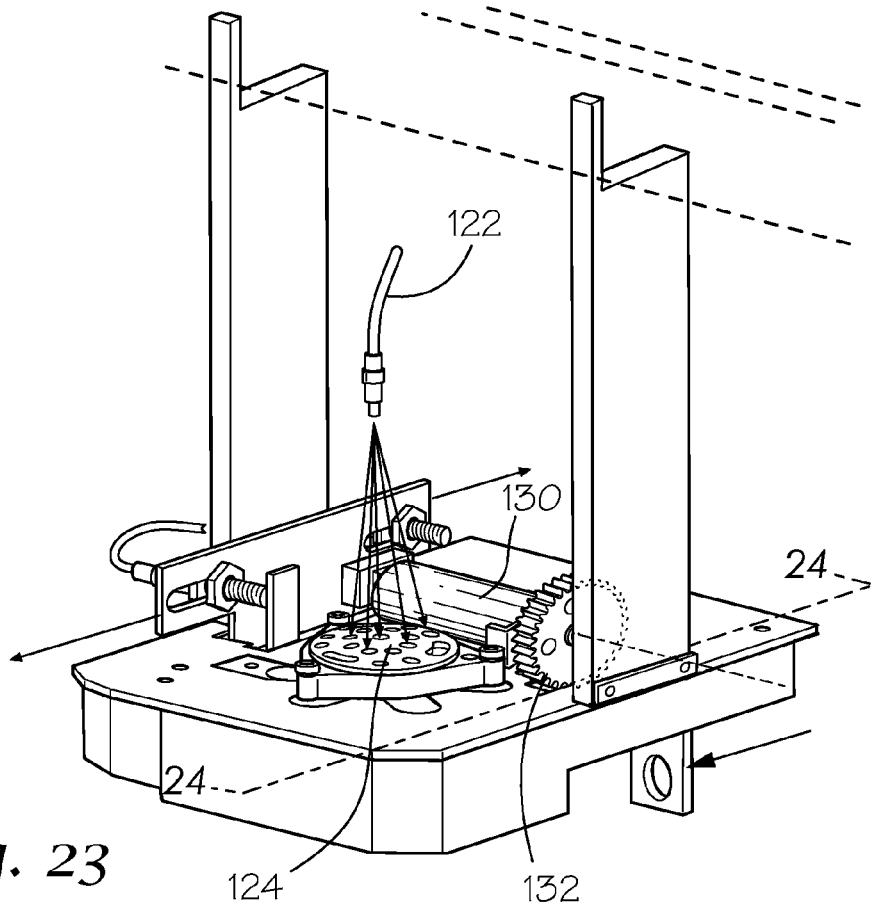
FIG. 23 shows a detailed perspective view of a nozzle head and drip tray according to the present invention.
Figure 24A:
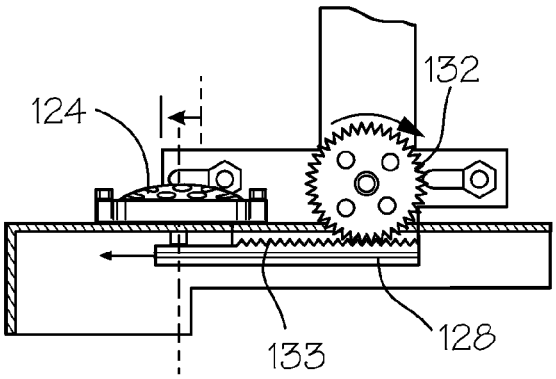
FIGS. 24A and 24B show a side cross-section view of the nozzle head and drip tray assembly showing the drip tray moveable between extended and retracted positions underneath the nozzle head according to the present invention.
Figure 24B:
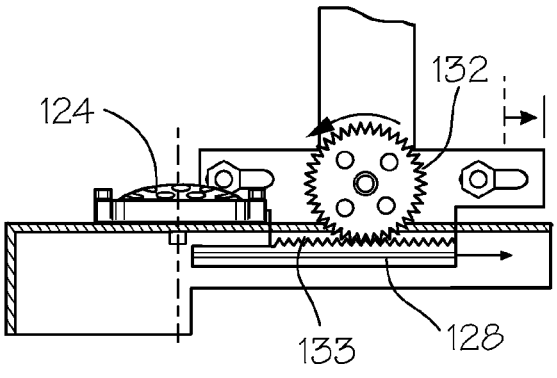

Rotation of clamp mount plate 98 may be accomplished by a servo motor so that the exact amount of rotation and movement can be precisely controlled and monitored. Additionally, referring to FIGS. 18 and 19, monitoring rotation of clamp mount plate 98 is a pair of contact sensors 112 and 114 that indicates when clamp mount plate 98 has reaches a stop position and when clamp mount plate 98 is not in a stop position. With further reference to FIG. 17A, as clamp mount plate 98 is rotated, a bar 116*a* or 116*b* engages a lever 118 to move lever 118 to contact one of sensors 112 and 114 to indicate the position of clamp mount plate 98. Before removing cap 22*a*, once clamp mount plate 98 rotates to the stop position, it is backed off from the stop position, approximately 15-20 degrees of rotation. Removal of cap 22*a* is accomplished without turning clamp mount plate 98 against a mechanical stop position. This is important because when cap 22*a* is reattached, the system monitors the amps of motor 100. Thus, when container 22 returns from receiving colorant paint solution, grab plate 95 lowers cap 22*a* back onto container 22 and clamp mount plate 98 is rotated to tighten cap 22*a* onto container 22. When cap 22*a* is being tightened, the amps output by motor 100 will rise and ultimately spike when cap 22*a* is sufficiently tight on container 22. If clamp mount plate 98 was allowed to rotate to the stop position detected by sensors 112 and 114, then the spike in motor 100 amps could be a result of reaching the stop position and not a result of the cap being properly tightened on container 22. The reason for backing off the stop position thus becomes apparent so that a false reading is not received in the cap reattachment process.

Following removal of cap 22*a*, shuttle unit 24 transports an open container 22 to colorant dispensing unit 28 for injecting colorant paint solution into said base paint solution. Referring to FIGS. 22-24B, colorant dispensing unit 28 includes a series of colorant reservoirs 120 containing various colorant paint solutions. The colorant paint solution is delivered in fluid communication through tubes 122 to a nozzle head 124. The flow of colorant is precisely controlled by pump 126 operatively associated with each colorant reservoir and delivering the colorant paint solution into tubes 122. A drip tray 128 covers a bottom side of nozzle head 124 to prevent any excess drips from entering container 22 during the tinting process. A motor 130 is operatively connected to drip tray 128 by a gear arrangement in which a drive gear 132 engages a gear track 133 in drip tray 128 for moving the tray. Drip tray 128 between a retracted position in which nozzle head 124 is exposed to the open paint container 22 for dispensing colorant, and an extended position in which drip tray 128 is disposed directly underneath nozzle head 124 but above container 22 so that the discharge ports of nozzle head 124 are covered to prevent drips of colorant solution from falling into the rest of the machine or an open paint container on shuttle unit 24. In the illustrated embodiment, the colorant dispensing unit 28 is derived from the Corob™ D200 unit sold by CPS Color, 7295 West Winds Blvd., Concord, N.C. 28078. The D200 has been modified to fit within support frame 18 to provide the colorant ability for the present invention.

In the event of a problem with container 22, for example, it is delivered upside down to shuttle unit 24, container 22 can be discarded. There are various reasons a paint container may be discarded, for example, the wrong base solution was dispensed, the label does not read properly by scanner 91, or a fault in the system in tightening cap 22*a*, are just a few anticipated possible problems. Accordingly, when an error in the vending process occurs, container 22 is ejected from container carrier 70 into discard chute 36. Referring to FIGS. 25-27, discard chute 36 is disposed adjacent shuttle track 72 and is carried by support frame 18. Discard chute 36 includes an inclined collection bin 134 for holding a plurality of paint containers 22. As a container is ejected from container carrier 70, gravity feeds the ejected container 22 down into bin 134. An ejector arm 136 is pivotally mounted to a support bracket 138 carried by support frame 18 generally beneath an upper receiving opening 140 of bin 134. A push plate 142 is carried by a distal end of ejector arm 136 for engaging container 22 through opening 90 (FIG. 15) in container carrier 70 and lifting the container above container carrier 70 and carrier clamp 82 for entering receiving opening 140 of bin 134. Push plate 142 is angled on ejector arm 136 so that in a fully extended position it extends generally to receiving opening 140 at the same angle of inclination as bin 134 so that container 22 slides from push plate 142 into receiving opening 140. An actuator 144 is operatively connected to ejector arm 136 for moving ejector arm 136 between a retracted position, in which container carrier 70 can pass directly over ejector arm 136, and an extended position, in which ejector arm 136 extends upward through opening 90 in container carrier 70 for engaging a bottom side of container 22. A pair of position sensors 146 and 148 may be provided to monitor the position of ejector arm 136 as it from retracted to extended positions.

Referring to FIG. 29, in the illustrated embodiment, following discard chute 19, a printer unit 150 is provided for labeling cap 22*a* of container 22. Generally, any desired information can be printed on cap 22*a*, for example, the paint color/number, store purchased, date provided, etc. Printer unit 150 can be, for example, an ink jet printer or laser printer adapted for printing on cap 22*a*, which is typically a plastic material. Any printing means may be utilized and the invention is not limited to the examples noted above. In the illustrated embodiment, however, an ink jet printer has repeatedly labeled plastic paint container caps without issue and is a cost effect method of quickly noting custom mixing information about the paint sample on container 22. To position printer 150, a printer support frame 152 is mounted to shaker track 160 so that printer 150 is disposed generally adjacent shuttle track 72. Container carrier 70 can then pass directly under printer 150 on route to shaker unit 30. As the paint container passes on the fly underneath printer 150, cap 22*a* is printed as desired.

Following tinting and cap reattachment, shuttle unit 24 transfers container 22 to shaker unit 30 which spins container 22 in a multi-axis mixing rotation movement to mix the base paint solution with the colorant paint solution. The duration of the mixing cycle can be varied depending on the type of color being created. Generally, darker colors require longer duration mixing cycles than lighter colors to obtain a generally uniform color in container 22. Regardless, the shaker unit detailed herein produces a multi-axis mixing motion capable of mixing a generally 8 fluid ounce container in less than 2 minutes. In some cases, with light colors the shaker unit can uniformly mix the paint solutions in about 30-45 seconds.

Referring to FIGS. 28-35B, shaker unit 30 includes a shaker track, designated generally as 160, mounted to support frame 18. Shaker track 160 is mounted in a generally vertically orientation and operates as a guide track and sub-frame to raise and lower a shaker, designated generally as 162, to receive container 22 from container carrier 70. Shaker track 160 includes a pair of spaced guide rails 164*a* and 164*b* arranged in a generally vertical orientation carried on support frame 18. A mounting bracket 166 is disposed between guide rails 164*a* and 164*b* carrying shaker 162 and operatively connected to the guide rails to slide along them in the same manner as bracket 74 on shuttle track 72 of shuttle unit 24. In the illustrated embodiment, mounting bracket 166 includes a tongue and groove arrangement with the guide rails 164*a* and 164*b* as used by shuttle unit 24 for directing mounting bracket 166 along the rails.

Figure 31:
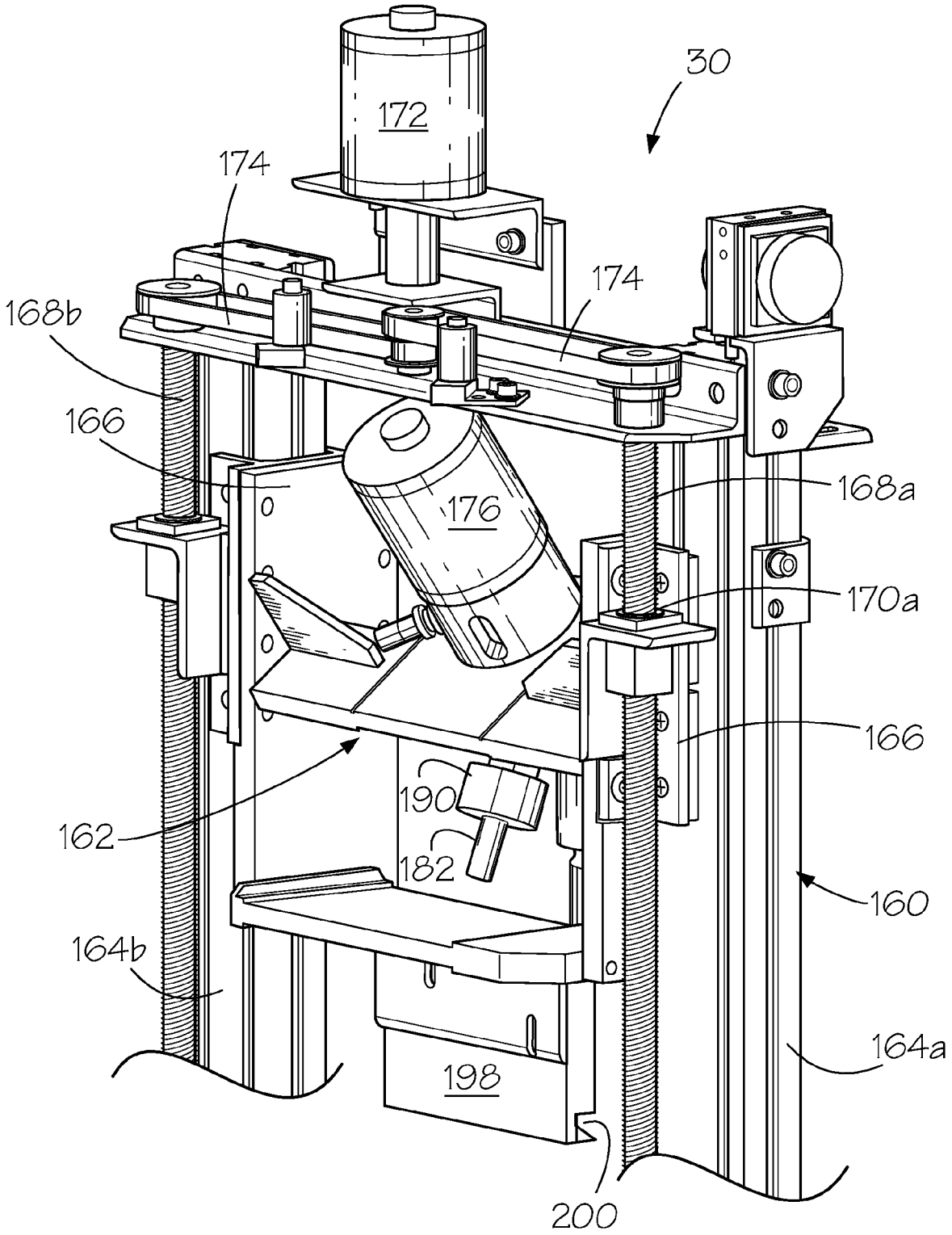
FIG. 31 shows a review perspective view of the shaker unit according to the present invention.
Figure 32:
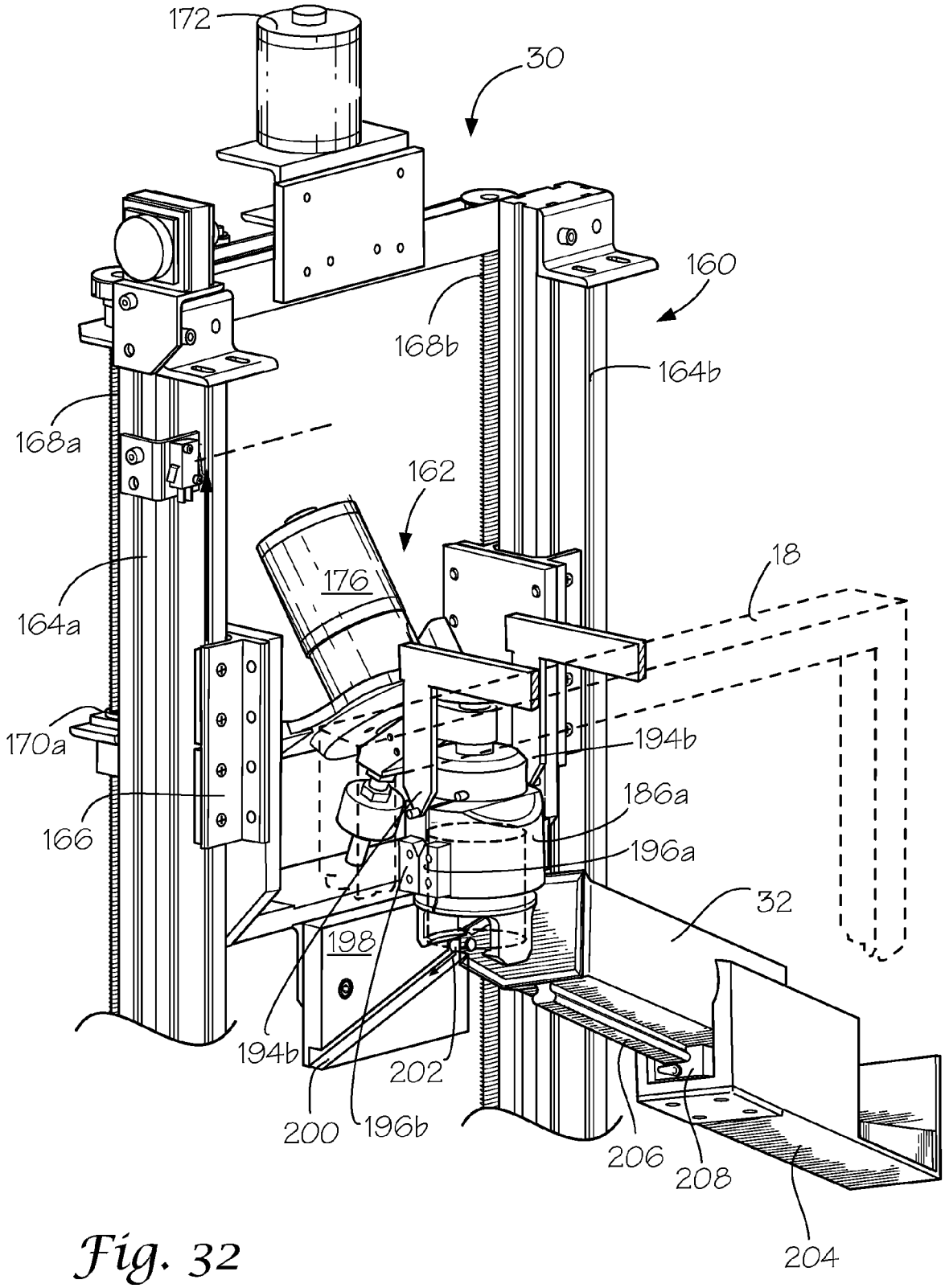
FIG. 32 shows a perspective view of the shaker unit operatively associated with the deliver chute according to the present invention.

As best shown in FIG. 31, to accomplish the vertical movement of mounting bracket 166 and shaker 162, a pair of screw shafts 168*a* and 168*b* are provided running parallel along each of guide rails 164*a* and 164*b*. A pair of treaded collars 170*a* and 170*b* are carried on each side of mounting plate 166 that are operatively connected to screw shafts 168*a* and 168*b*, respectively. A motor 172 is connected to screw shafts 168*a* and 168*b*, for example, via a belt drive arrangement, designated generally as 174, or other suitable arrange to cause rotation of screw shafts 168*a* and 168*b*. This, again, is the same basic arrangement as described above to cause movement of container carrier 70 in shuttle unit 24. As noted above, in a preferred embodiment, motor 172, is a servo motors so that the system can precisely monitor the exact location of mounting bracket 166 along shaker track 160. Alternatively, as with shuttle unit 24, to monitor the position of shaker 162, a cable measurement monitoring device can be connected to mounting plate 166.

Figure 33:
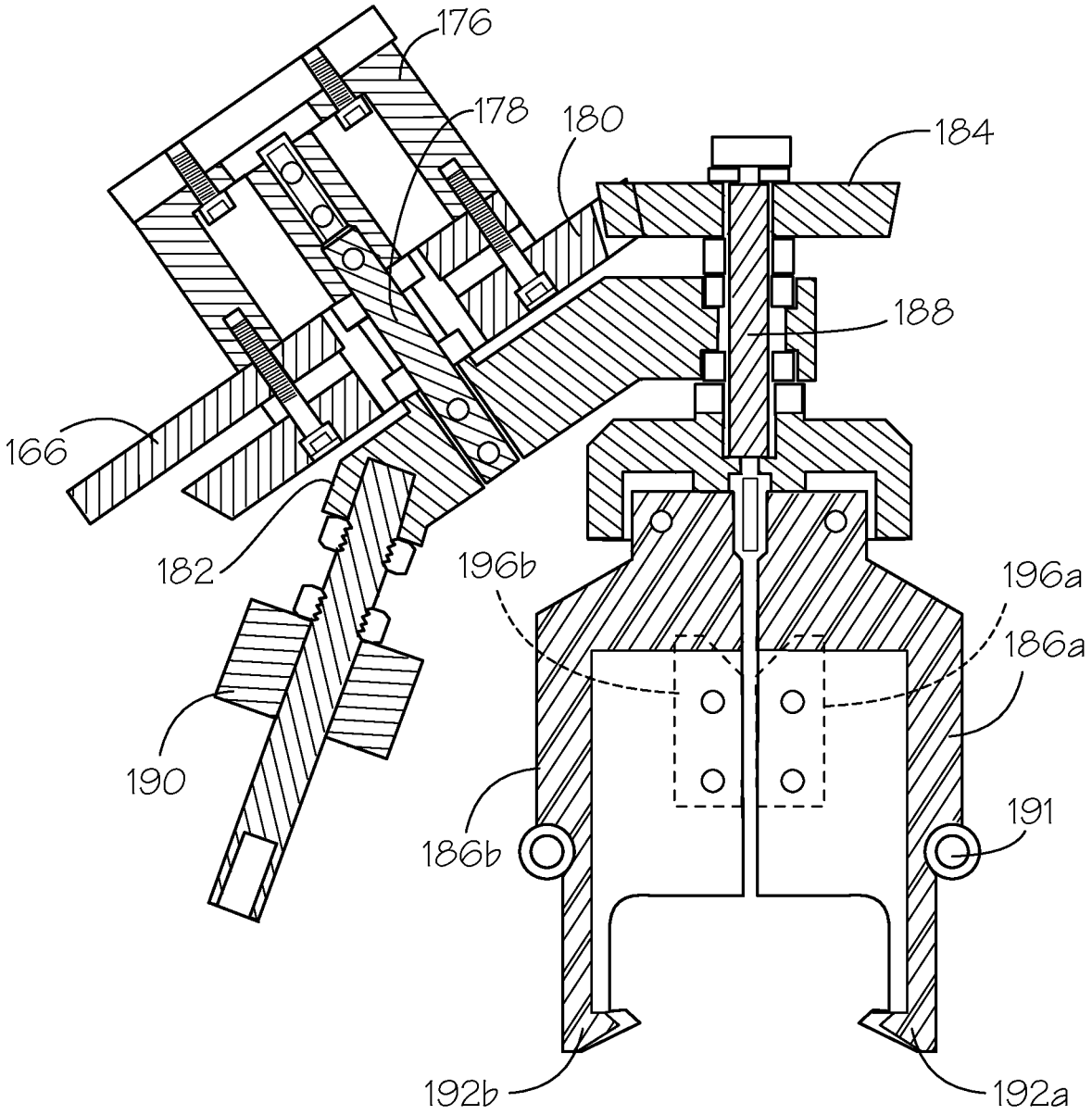
FIG. 33 shows a cross-section of the shaker mechanism according to the present invention.
Figure 34B:
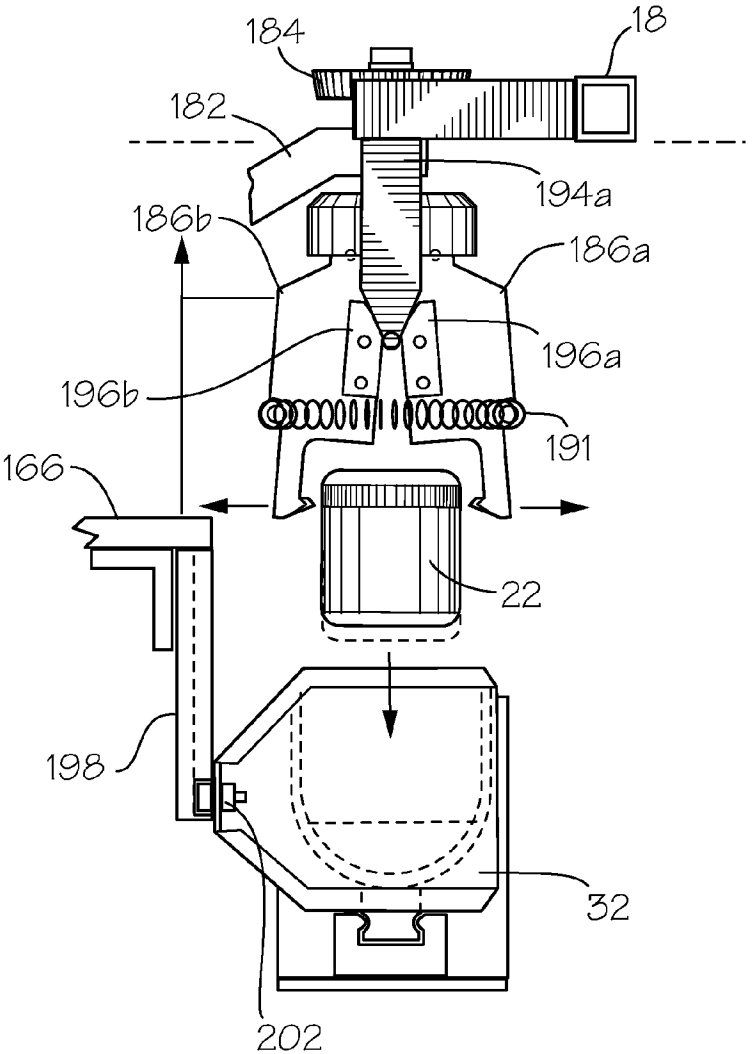
FIGS. 34A and 34B show a side view of release blocks carried on the jaws of the shaker mechanism moving to engage prongs to open the jaws and release the container to the delivery chute according to the present invention.
Figure 34A:
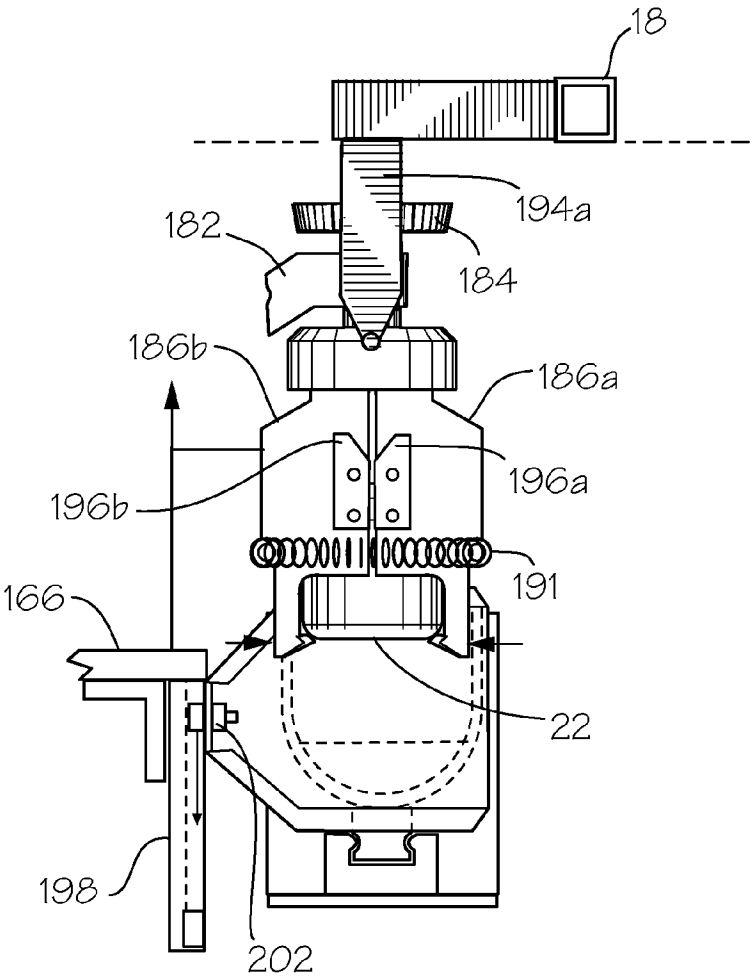
Figure 35B:
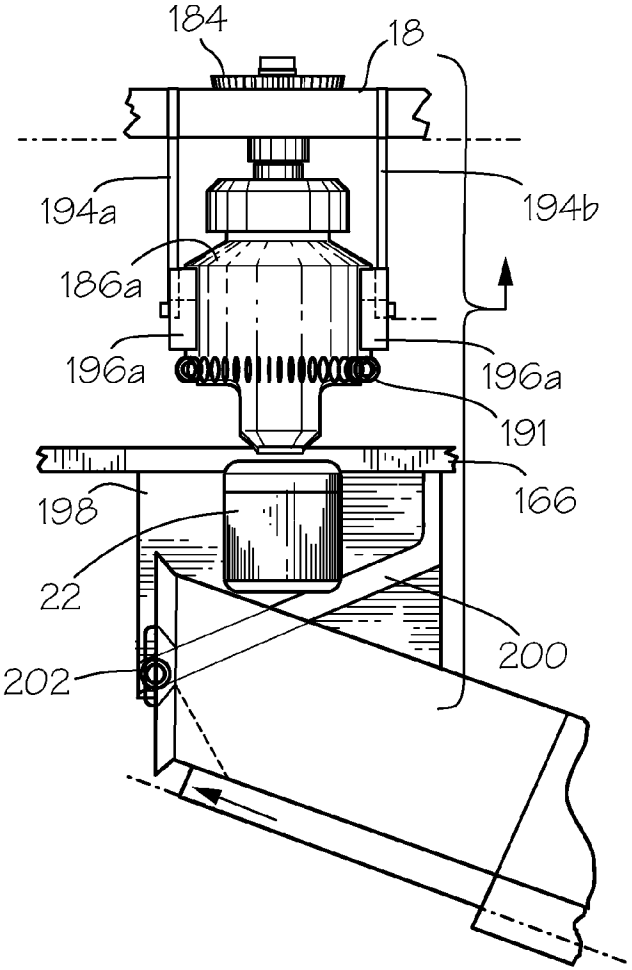
FIGS. 35A and 35B show a front view of the a slot plate of the shaker unit operatively associated with a guide rod of the delivery chute to move the delivery chute between extended and retracted positions under the shaker mechanism according to the present invention.
Figure 35A:
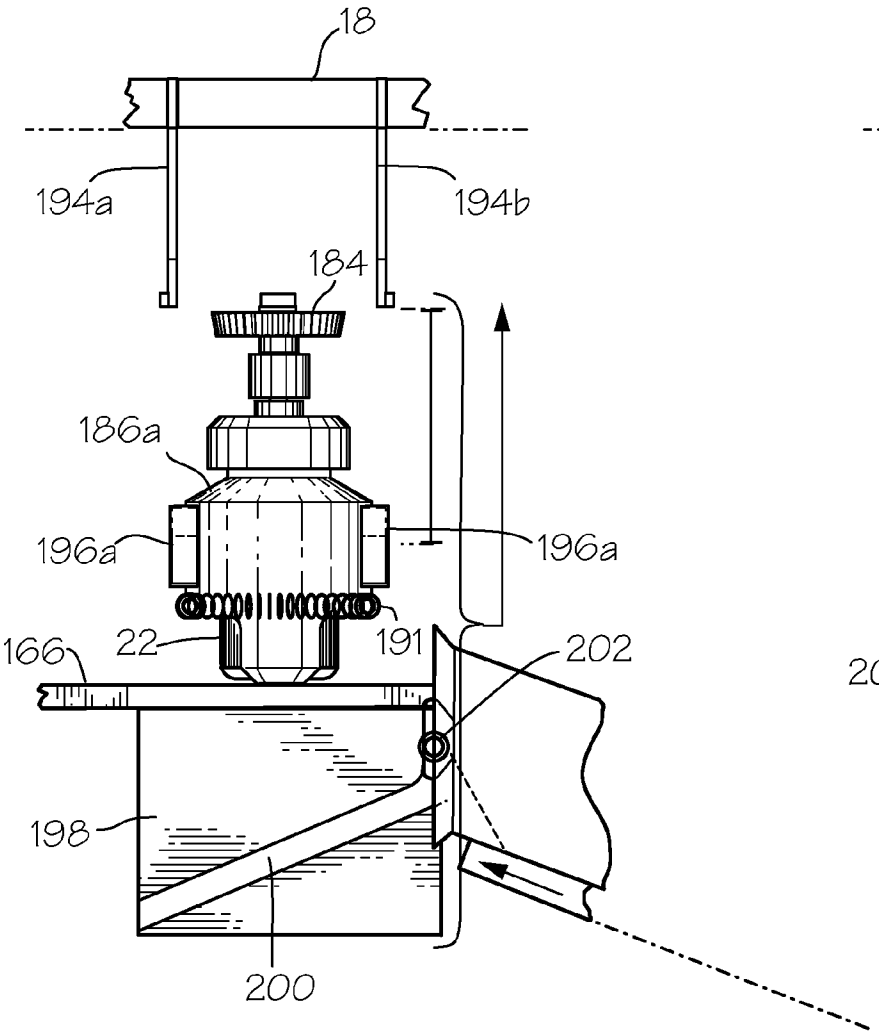
Figure 36:
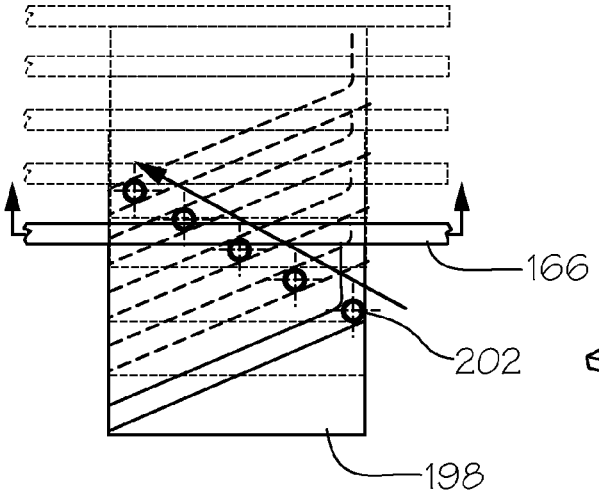
FIG. 36 shows a schematic of the slot plate and guide rod cooperation as the shaker unit is being raised along the shaker unit track according to the present invention.
Figure 37:
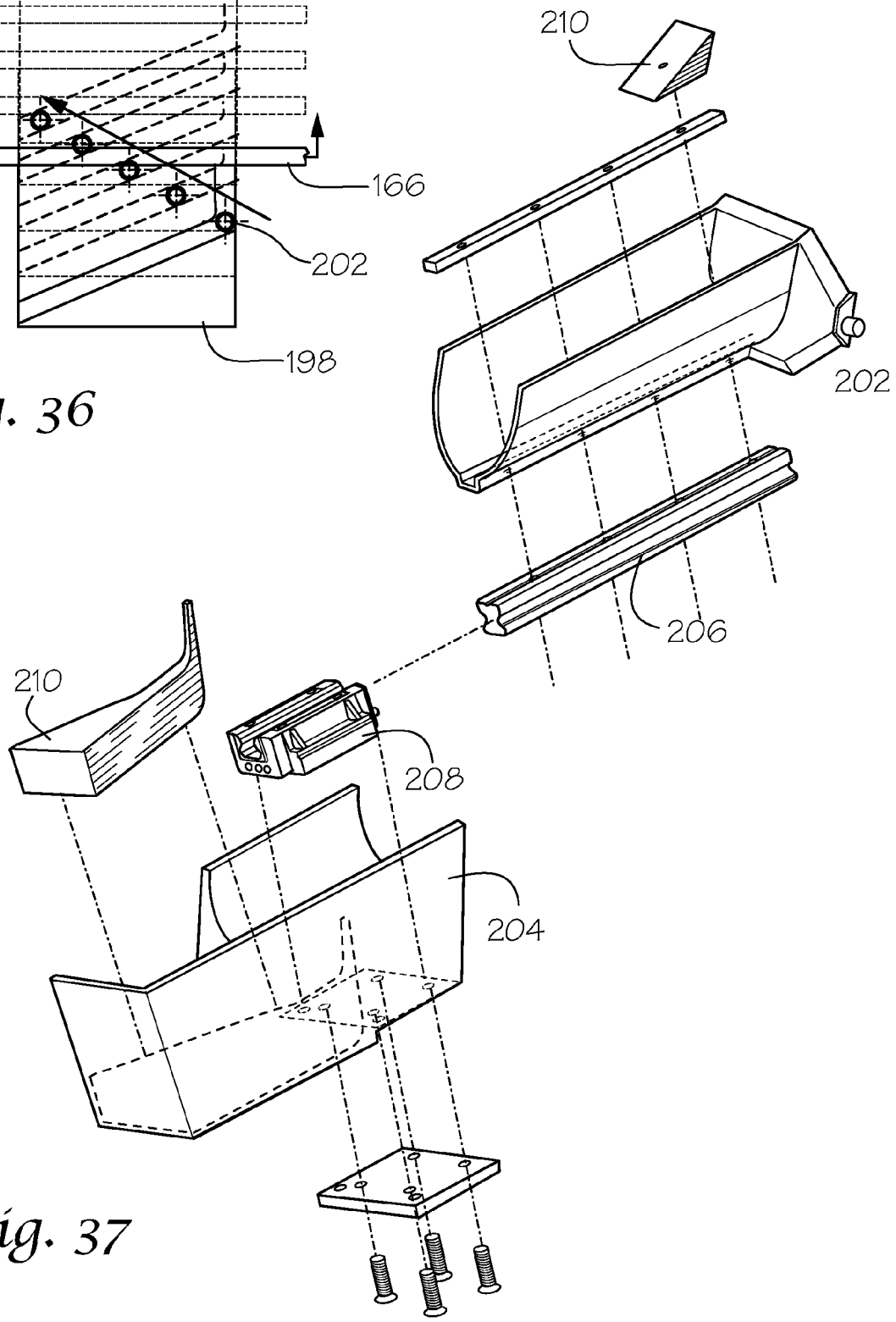
FIG. 37 shows an exploded perspective view of the delivery chute according to the present invention.
Figure 38A:
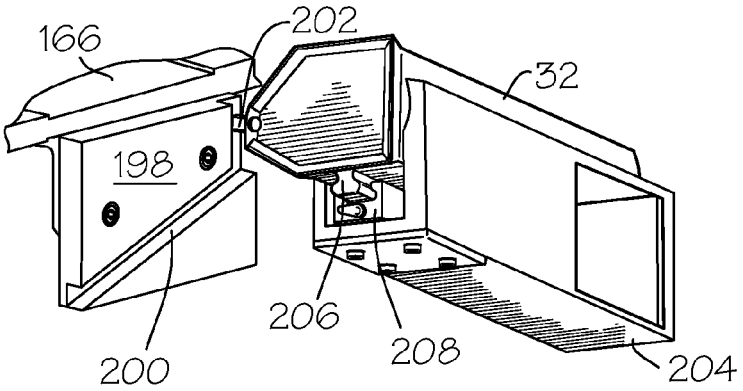
FIGS. 38A-38C show a detailed perspective view of the cooperation between the slot plate of the shaker unit and guide rod of the delivery chute moving the delivery chute from a retracted position to an extended position underneath the container in the shaker mechanism according to the present invention; and, FIG. 39 shows a detailed perspective view of the delivery chute according to the present invention.
Figure 38B:
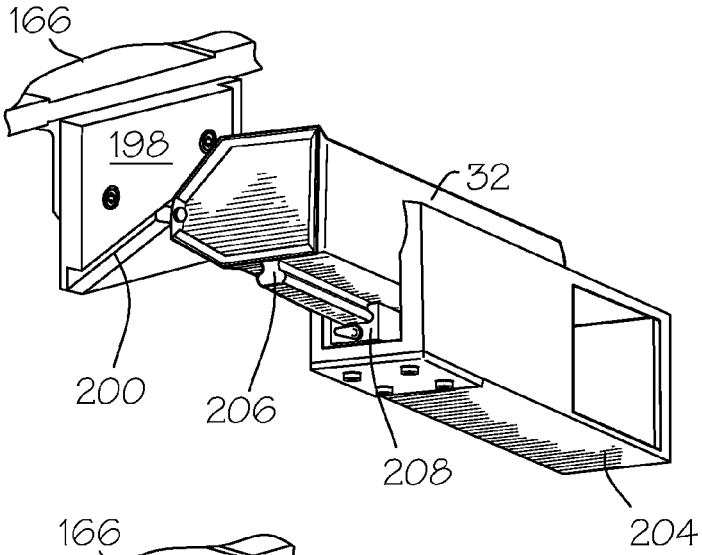
Figure 38C:
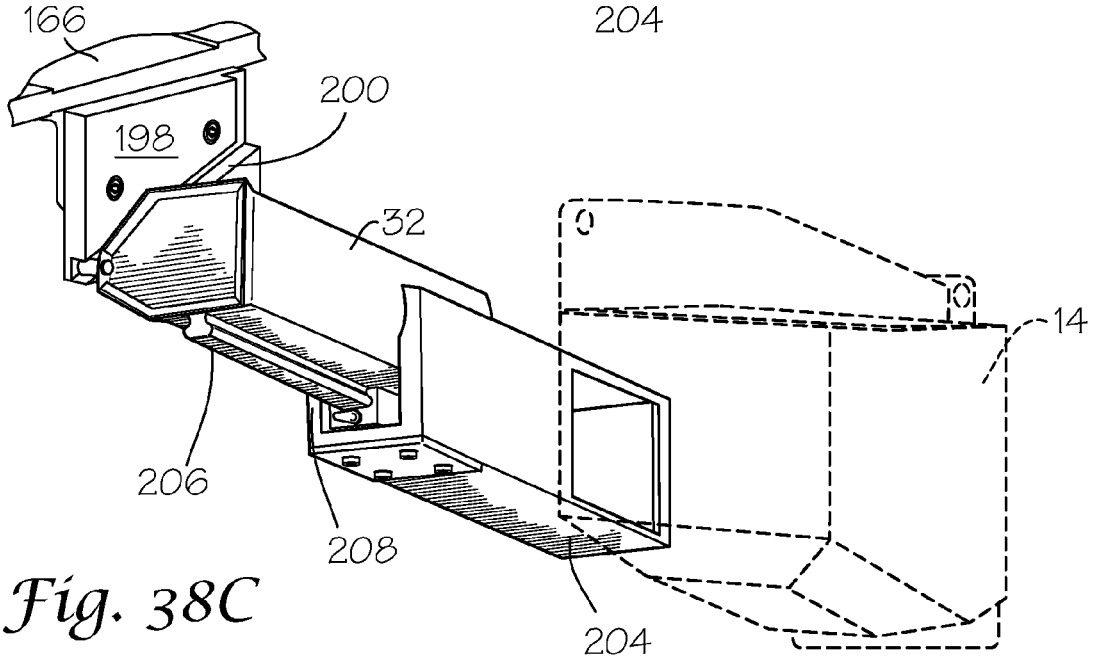
Figure 39:
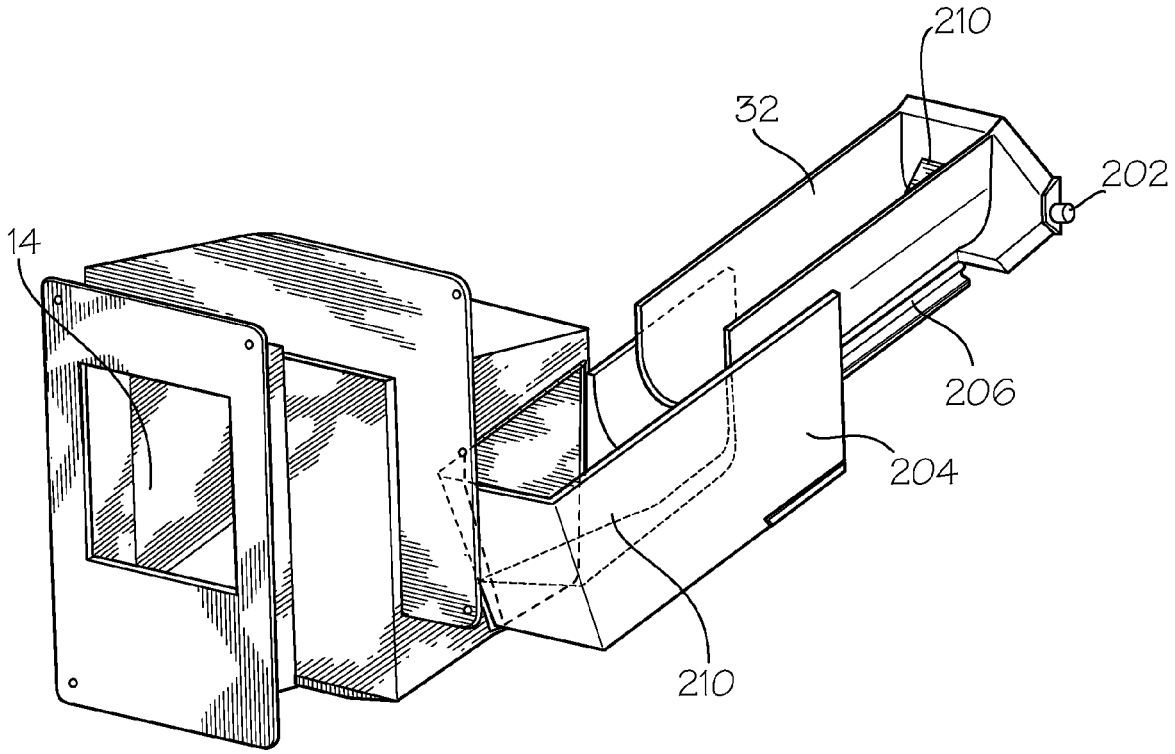

Referring to FIG. 33, in the illustrated embodiment, shaker 162 carried by mounting bracket 166 includes an electric motor 176 mounted to bracket 166. A drive shaft 178 extends through a stationary center gear 180 to a carrier arm 182. Stationary center gear 180 is bolted or otherwise affixed to at least one of mounting bracket 166 or motor 176. Carrier arm 182 is affixed to drive shaft 178 to that rotation of drive shaft 178 causes rotation of carrier arm 182. At one end of carrier arm 182 is an orbit gear 184 rotatably mounted to carrier arm 182 for cooperating with stationary center gear 180. A set of opposing jaws 186*a* and 186*b* are pivotally mounted on carrier arm 182 for engaging container 22. Jaws 186*a* and 186*b* are connected by a shaft 188 to orbit gear 184. A counter balance weight 190 is carried at an opposite distal end of carrier arm 182. Accordingly, as electric motor 176 turns carrier arm 182, orbit gear 184 is caused to rotate around stationary gear 180. This in turn causes rotation of orbit gear 184 which turns jaws 186*a* and 186*b* holding container 22. Thus, a first axis of rotation is provided by the movement of carrier arm 182, and a second axis of rotation is provided by the spinning of jaws 186*a* and 186*b* holding container 22 to provide the multi-axis rotation movement. As noted above, in a preferred embodiment, motor 176, is a servo motors so that the system can precisely monitor the exact rotational movement of carrier arm 182 and, thus, the position of jaws 186*a* and 186*b*.

Figure 30A:
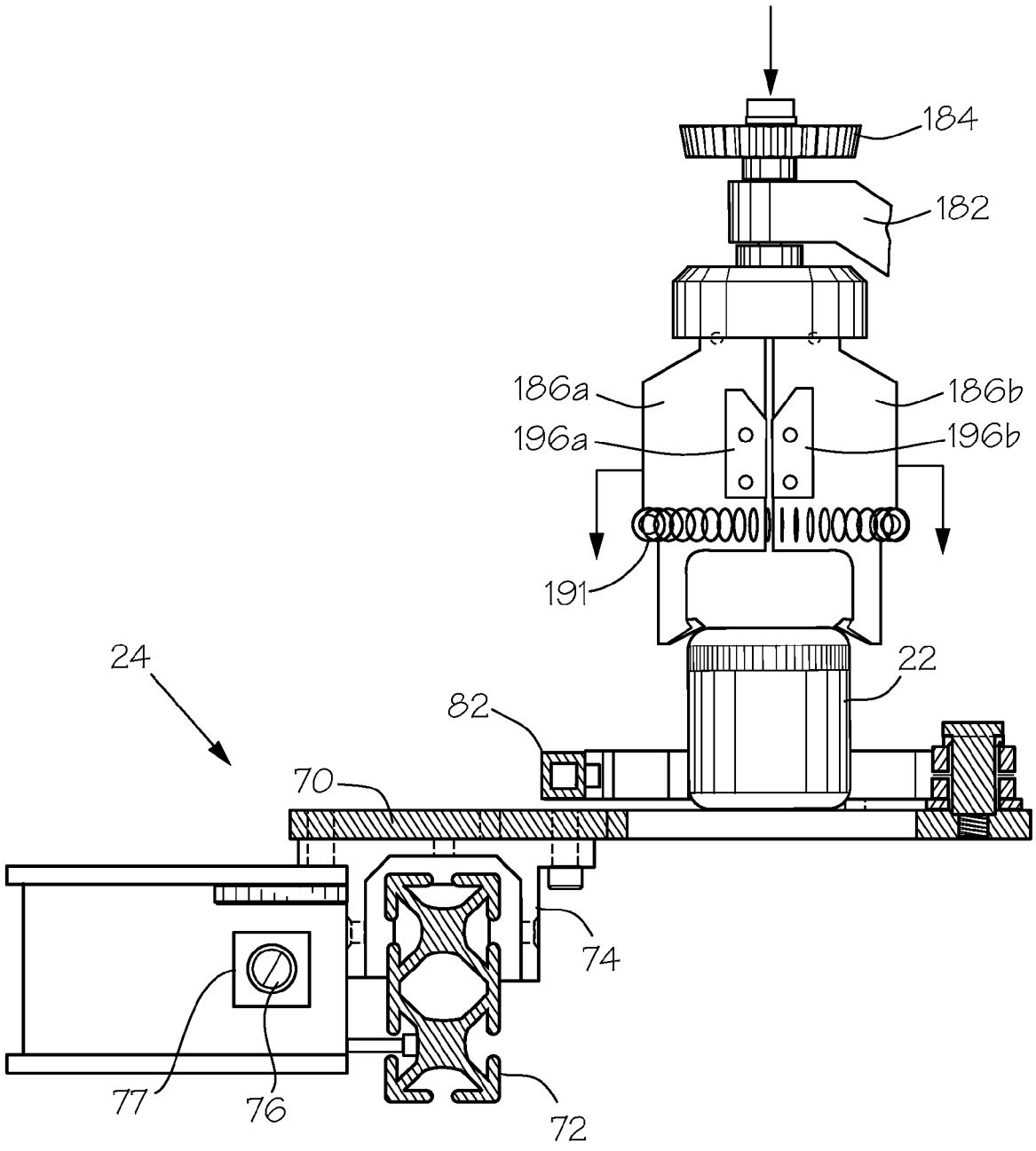
FIGS. 30A-30C show the jaws of the shaker unit receiving the container from the shuttle unit according to the present invention.
Figure 30B:
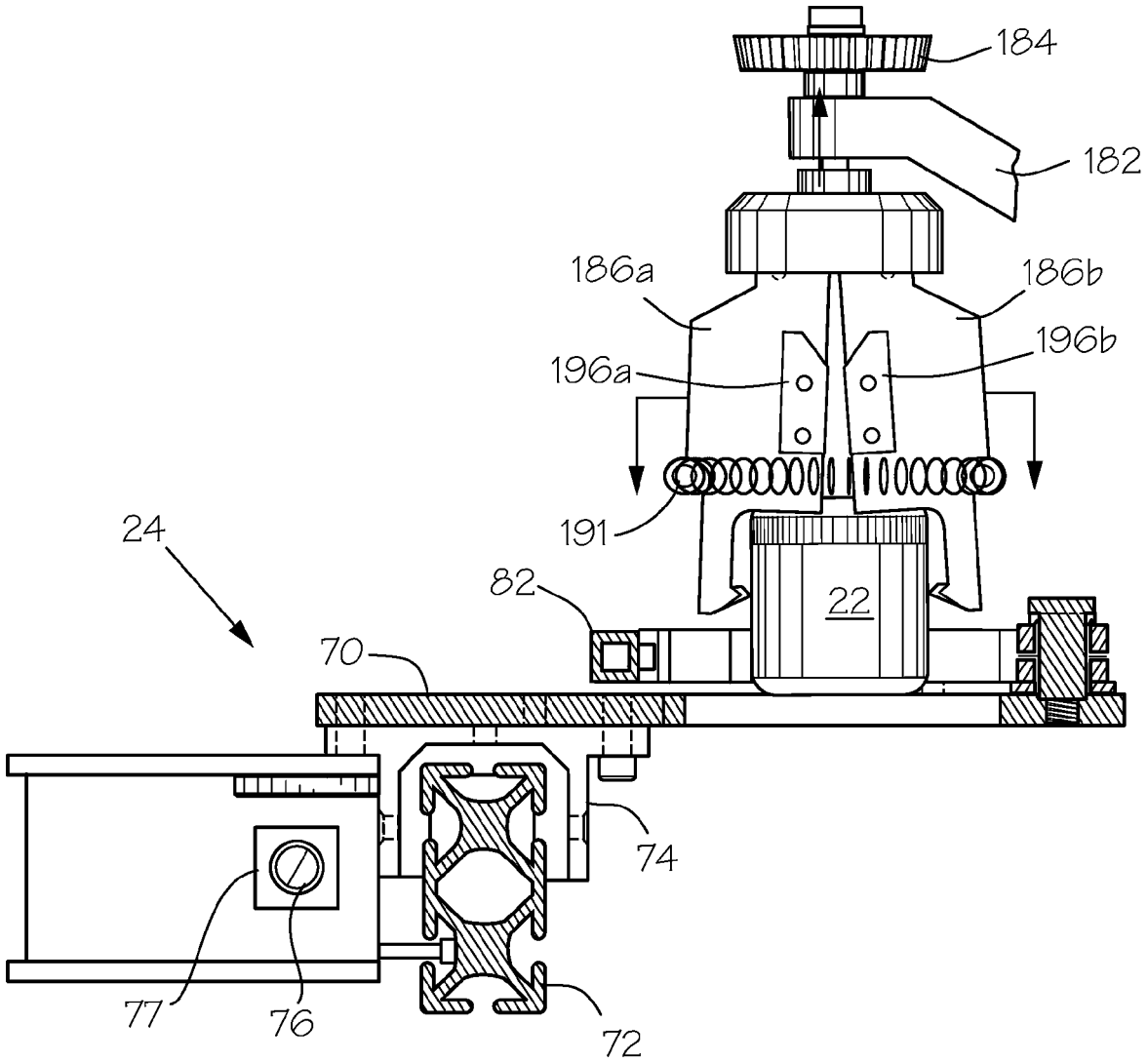
Figure 30C:
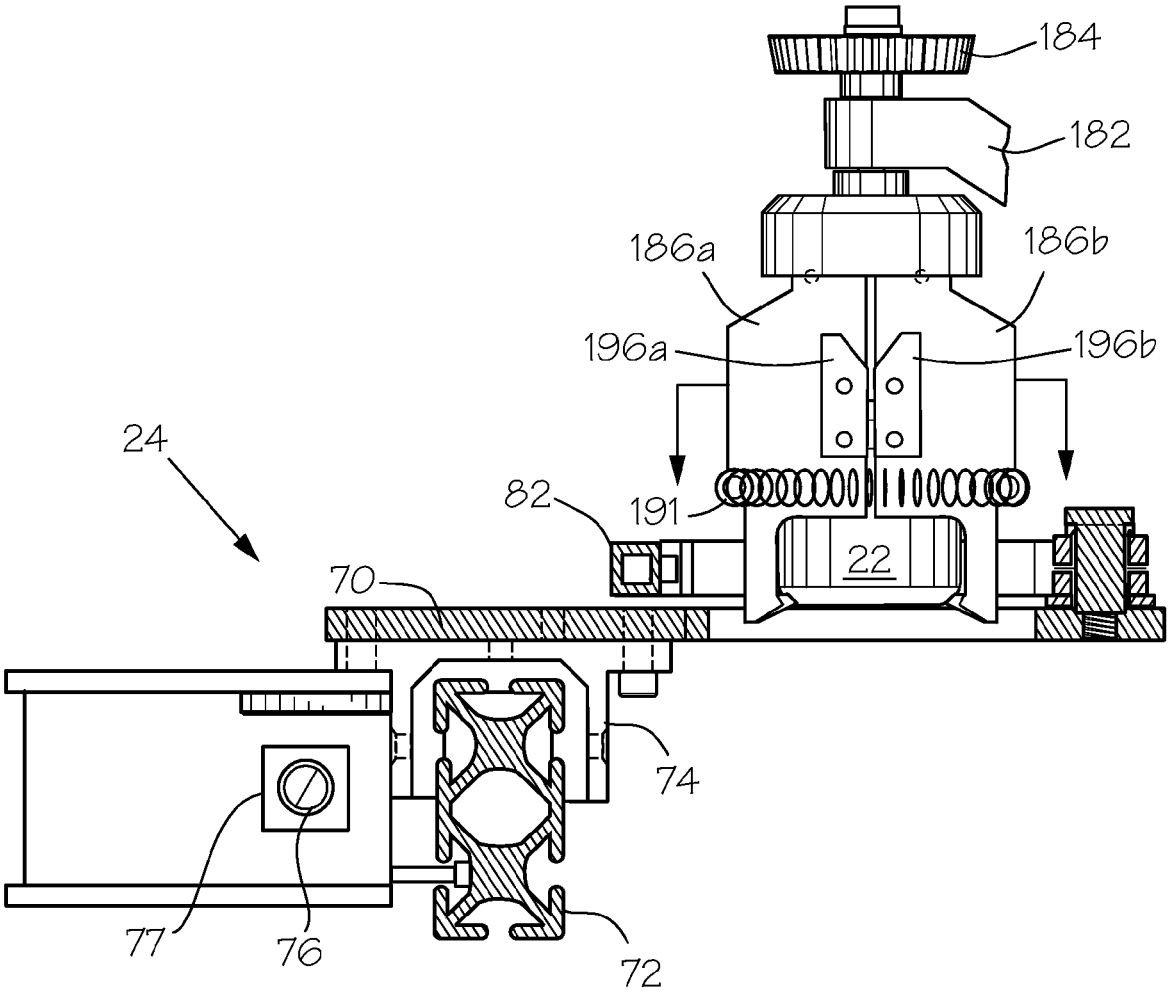

Shaker 162 is movably mounted to the shaker guide track 160 so that shaker 162 is operable between a lowered position receiving container 22, a raised mixing position for mixing the containers, and a raised release position for transferring the containers to delivery chute 32. Referring to FIGS. 30A-30C and Jaws 186*a* and 186*b* are spring biased by wrapping a coil spring 191 around the outside of the jaw so that as shaker 162 is lowered over container 22 on container carrier 70, jaws 186*a* and 186*b* are spread open by the top of container 22 engaging tapered lips 192*a* and 192*b* on the jaws. The jaws then clamp around the bottom side of container 22 through opening 90 in container carrier 70. Shaker 162 is then raised to the mixing position clear of shuttle unit 24 for the mixing cycle. Following the mixing cycle, shaker 162 is raised further to the raised release position where container 22 is released to delivery chute 32.

Referring to FIGS. 34A-35B, a pair of prongs 194*a* and 194*b* are carried by support frame 18 and aligned vertically over jaws 186*a* and 186*b*. A pair of release blocks 196*a* and 196*b*, in the form of rubber or plastic blocks, are carried on opposing sides of each jaw portion engage prongs 194*a* and 194*b*, respectively. As shaker 162 is raised to the raised release position, prongs 194*a* and 194*b* extend between opposing release blocks on each side of jaws 186*a* and 186*b*, which force the jaws to separate and release container 22 into delivery chute 32.

Further referring to FIGS. 36-39, mounting bracket 166 carries a slot plate 198 having an angled groove 200 receiving a guide rod 202 carried by delivery chute 32. As shaker 162 is raised to the raised release position following mixing of container 22, guide rod 202 engages groove 200 which causes delivery chute 32 to be drawn underneath jaws 186*a* and 186*b* as shaker 162 rises. As shown in FIG. 38A, delivery chute 32 is retracted as shaker 162 rises upward. In FIG. 38B, delivery chute 32 is being extended as shaker 162 moves upward. Finally, in FIG. 38C, delivery chute 32 is fully extended underneath the jaw to catch a released container 22. Accordingly, as jaws 186*a* and 186*b* are forced open by prongs 194*a* and 194*b*, container 22 drops into delivery chute 32 which is now positioned under the jaws.

Delivery chute 32 is slidably mounted on a support trough 204 carried by support frame 18. Delivery chute 32 includes a guide rail 206 carried on a bottom side of delivery chute 32. Guide rail 206 engages a receiver 208 carried by support trough 204 having a groove complementary in shape to guide rail 206 to secure guide rail 206 in receiver 208 while allowing for lateral movement of guide rail 206 through receiver 208. Support trough 204 extends to opening 14 in the housing of the vending machine for delivering container 22 to the customer. Delivery chute 32 and support trough 204 may include a series of bumpers 210 to help direct container 22 to opening 14. As shaker 162 is lowered, delivery chute 32 is forced back from underneath jaws 186*a* and 186*b* by guide rod 202 moving through groove 200 of slot plate 198.

While a preferred embodiment of the invention has been described using specific terms, such description is for illustrative purposes only, and it is to be understood that changes and variations may be made without departing from the spirit or scope of the following claims.

What is claimed is:

1. A paint sample mixing and vending machine, comprising:

an inventory section including a series of rail units defining an arrangement of inclined troughs, wherein a plurality of containers each holding a base paint solution and having a removable cap are carried in said troughs;

a control gate included in said inventory section carried at a distal end of each of said rail units for individually dispensing said containers from said rail units into a feed chute;

a shuttle unit including a container carrier movably mounted to a shuttle track, wherein said container carrier receives said containers from said feed chute and transports said containers along said shuttle track;

a capping unit disposed adjacent said shuttle track engaging said removable cap on said containers to remove and reattach said cap on said containers;

a colorant dispensing unit disposed adjacent said shuttle track including a plurality of colorant paint solution reservoirs connected in fluid communication to a nozzle head, wherein said colorant paint solution is dispensed into said base paint solution of said containers following removal of said cap by said capping unit;

a shaker unit disposed adjacent said shuttle track receiving said containers from said container carrier following reattachment of said cap by said capping unit, wherein said shaker unit spins said containers in a multi-axis rotation movement to mix said base paint solution with said colorant paint solution; and, a delivery chute receiving said containers from said shaker unit after mixing for dispensing from the machine.

2. The vending machine of claim 1 wherein each of said rail units includes a series of vertically spaced and inclined trough sections, and wherein adjacent distal ends of said trough sections are interconnected by end caps having a curved interior chute to transfer containers from a distal end of one of said inclined trough sections to a start of another so that a single continuous inclined trough is formed to deliver a supply of said containers to said feed chute.

3. The vending machine of claim 1 wherein said control gate on each of said rail units includes a pair of rotatable cams interconnected by a series of crossbars that extend across each of said inclined troughs for controlling the dispensing of said containers into said feed chute.

4. The vending machine of claim 3 including an actuator operatively associated with one of said crossbars to rotate the cams between a forward position wherein one of said crossbars is positioned to block said containers from feeding into said feed chute, and a rearward position in which said crossbars are positioned so that a container located at said distal end of said rail units is free to enter said feed chute while a remainder of said containers in said rail unit are blocked from entering said feed chute.

5. The vending machine of claim 1 including a plurality of guide rails disposed in said feed chute cooperating with said containers to position said containers onto said container carrier of said shuttle unit.

6. The vending machine of claim 1 wherein said container carrier includes a carrier clamp receiving said containers from said feed chute and securing said containers to said container carrier for transport along said shuttle track.

7. The vending machine of claim 6 wherein said carrier clamp includes a first clamping arm having a first recess complementary to an exterior surface of said containers, and a second clamping arm opposite said first clamping arm having a second recess complementary to said exterior surface of said containers so that said first and second recess cooperate to hold said containers on said container carrier.

8. The vending machine of claim 7 wherein at least one of said first and second clamping arms is movable relative to the other of said clamping arms between an open position wherein said containers are received onto said container carrier between said clamping arms, and a closed position wherein said containers are clamped in position on said container carrier.

9. The vending machine of claim 7 including a linear actuator operatively associated with at least one of said first and second clamping arms for moving said clamping arms to clamp and release said container from said container carrier.

10. The vending machine of claim 1 including a bar code scanner disposed adjacent said shuttle track for reading a bar code displayed on said containers as said containers are transported by said shuttle unit.

11. The vending machine of claim 1 including a printer disposed adjacent said shuttle track and engaging a portion of said containers passing along said shuttle track for printing information on said containers.

12. The vending machine of claim 1 wherein said capping unit includes a rotatable cap clamp engaging said removable cap on said containers to remove and reattach said cap on said containers.

13. The vending machine of claim 12 wherein said cap clamp is movable between a raised position allowing for said containers to pass underneath said cap clamp along said shuttle track, and a lowered position wherein said cap clamp engages said removable cap on said containers.

14. The vending machine of claim 1 wherein said colorant dispensing unit includes a drip tray operatively associated with said nozzle head so that said drip tray is disposed underneath said nozzle head when said colorant paint solution is not being dispensed into said base paint solution of said containers and retracted when said colorant paint solution is being dispensed into said containers.

15. The vending machine of claim 1 including a discard chute disposed adjacent to said shuttle track, wherein an ejector arm displaces said containers from said container carrier into said discard chute.

16. The vending machine of claim 1 wherein said shaker unit is movably mounted to a guide track so that said shaker unit is operable between a lowered position receiving said containers, a raised mixing position for mixing said containers, and a raised release position for transferring said containers to said delivery chute.

17. The vending machine of claim 1 wherein said shaker unit includes:

an electric motor having a drive shaft extending through a stationary center gear;

a carrier arm affixed to said drive shaft;

an orbit gear carried at one distal end of said carrier arm and rotatably mounted to said carrier arm for cooperating with stationary center gear;

a counter balance weight carried at an opposite distal end of said carrier arm; and, a pair of opposing jaws connected by a linkage to said orbit gear so that as said electric motor turns said orbit gear is caused to rotate around stationary gear which causes rotation of said jaws holding said containers to provide said multi-axis rotation movement.

18. The vending machine of claim 17 wherein said jaws are pivotally carried on said linkage and spring biased so that said jaws spread open over a top of said containers when said shaker unit is lowered over container carrier on said shuttle track, and wherein said jaws clamp around a bottom side of said containers to secure said containers in said shaker unit for mixing.

19. The vending machine of claim 18 including a pair of release blocks carried on opposing sides of each of said jaws engaging a pair of prongs carried by a support frame aligned vertically over jaws so that said prongs extend between said release blocks to cause said release blocks to separate laterally and force said jaws to open and release said containers into said delivery chute.

20. The vending machine of claim 1 wherein said shaker unit carries a slot plate having an angled groove receiving a guide rod carried by said delivery chute and said deliver chute is movably carried in a support trough, wherein vertical movement of said shaker unit causes said guide rod to move along said angled groove of said slot plate so that said delivery chute is extended underneath said shaker unit to receive said containers after mixing.

21. A paint sample mixing and vending machine, comprising:

an inventory section adapted for storing and dispensing containers with a removable cap and containing a base paint solution;

a shuttle unit operatively associated with said inventory section for receiving said containers to transport said containers for tinting and shaking of said base paint solution;

a cap removal and attachment unit operatively associated with said shuttle unit receiving said containers to remove and secure said cap on said containers;

a colorant dispensing unit operatively associated with said shuttle unit receiving said container with said cap removed and injecting colorant paint solution into said base paint solution; and, a shaker unit operatively associated with said shuttle unit receiving said container with said cap reattached, wherein said shaker unit rotates said container to mix said base paint solution with said colorant paint solution.

22. The vending machine of claim 21 including a delivery chute operatively associated with said shaker unit receiving said containers to exit the machine, wherein said delivery chute is disposed adjacent said shaker and has a retracted position allowing said shaker to move vertically above said delivery chute, and an extended position disposed underneath said shaker to receive said containers for delivery from said shaker unit.

23. A paint sample mixing and vending machine, comprising:

an inventory section adapted for storing and dispensing containers with a removable cap and containing a base paint solution;

a shuttle unit operatively associated with said inventory section for receiving said containers to transport said containers for tinting and shaking of said base paint solution;

a cap removal and attachment unit operatively associated with said shuttle unit receiving said containers to remove and secure said cap on said containers;

a colorant dispensing unit operatively associated with said shuttle unit receiving said container with said cap removed and injecting colorant paint solution into said base paint solution; and, a shaker unit operatively associated with said shuttle unit receiving said container with said cap reattached, wherein said shaker unit includes:

an electric motor having a drive shaft extending through a stationary center gear;

a carrier arm affixed to said drive shaft;

an orbit gear carried at one distal end of said carrier arm and rotatably mounted to said carrier arm for cooperating with stationary center gear;

a counter balance weight carried at an opposite distal end of said carrier arm; and, a pair of opposing jaws connected by a linkage to said orbit gear so that as said electric motor turns said orbit gear is caused to rotate around stationary gear which causes rotation of said jaws holding said containers to provide a multi-axis rotation movement to mix said base paint solution with said colorant paint solution.

* * * * *